US006479153B1

(12) United States Patent
Kato et al.

(10) Patent No.: US 6,479,153 B1
(45) Date of Patent: Nov. 12, 2002

(54) PROCESS FOR PRODUCING A LEATHER-LIKE SHEET

(75) Inventors: Mitsuru Kato, Kurashiki (JP); Hideaki Adachi, Kurashiki (JP)

(73) Assignee: Kuraray Co., Ltd., Kurashiki (JP)

( * ) Notice: Subject to any disclaimer, the term of this patent is extended or adjusted under 35 U.S.C. 154(b) by 0 days.

(21) Appl. No.: 09/536,718

(22) Filed: Mar. 28, 2000

(30) Foreign Application Priority Data

| | | |
|---|---|---|
| Mar. 30, 1999 | (JP) | 11-087839 |
| Mar. 30, 1999 | (JP) | 11-087840 |
| Apr. 20, 1999 | (JP) | 11-111576 |
| Apr. 20, 1999 | (JP) | 11-111577 |

(51) Int. Cl.[7] ..... B05D 3/02

(52) U.S. Cl. ..... 428/423.7; 428/423.1; 428/480; 428/904; 427/245; 427/246; 427/389.9; 427/393.5

(58) Field of Search ..... 427/243, 245, 427/246, 389.9, 393.5; 428/151, 904, 423.1, 295.1, 423.7, 480

(56) References Cited

U.S. PATENT DOCUMENTS 4,515,852 A * 5/1985 Katabe et al. ..... 273/DIG. 8
5,503,899 A * 4/1996 Ashida et al. ..... 428/151
5,876,466 A * 3/1999 Nakashima et al. ..... 8/442
6,013,364 A * 1/2000 Ashida et al. ..... 428/151
6,231,926 B1 * 5/2001 Ronzani et al. ..... 427/341
6,322,851 B1 * 11/2001 Adachi et al. ..... 427/246

* cited by examiner

*Primary Examiner*—Shrive P. Beck
*Assistant Examiner*—Kirsten A. Crockford
(74) *Attorney, Agent, or Firm*—Oblon, Spivak, McClelland, Maier & Neustadt, P.C.

(57) ABSTRACT

A leather-like sheet is prepared by impregnating a fibrous substrate, which may comprise a microfine fiber-forming fiber, with a thermally gellable composite resin emulsion obtained by emulsion-polymerizing an ethylenically unsaturated monomer (B) in the presence of a polyurethane emulsion (A) at a weight ratio of 90/10 to 10/90, solidifying the thermally gellable composite emulsion in the impregnated fibrous substrate, and if the fibrous substrate is a microfine fiber-forming fiber, converting the microfine fiber-forming fiber to a microfine fiber. After impregnation, the emulsion in the impregnated fibrous substrate is thermally solidified, thereby producing a leather-like sheet having excellent softness and fulfillment feeling, and good hand feel, feel and physical properties like that of natural leather. A film of the composite resin has a specific elastic modulus.

22 Claims, No Drawings

PROCESS FOR PRODUCING A LEATHER-LIKE SHEET

BACKGROUND OF THE INVENTION

1. Field of the Invention

The present invention relates to a leather-like sheet and the process for producing it. More specifically, the present invention relates to leather-like sheets, and a process for producing such sheets in which a fibrous substrate comprising an ordinary fiber or a microfine fiber is impregnated with a specific composite resin emulsion and then the emulsion is solidified. The leather-like sheet of the present invention has far more satisfactory softness and fulfillment feeling than conventional leather-like sheets obtained by first impregnating a fibrous substrate with an emulsion type resin and then drying and solidifying the resin. The leather-like sheets of the present invention have good endurance, an excellent and high-grade hand feel, and feel like natural leather.

2. Discussion of the Background

Until now, artificial leathers used as substitutes for natural leathers were made by impregnating a fibrous substrate with a resin binder, such as a polyurethane. One of two processes are typically used for producing artificial leather sheets: the wet process and the dry process. In the wet process, a fibrous substrate is impregnated with a solution in which a resin component is dissolved in an organic solvent, for example a polyurethane dissolved in dimethylformamide. The resulting impregnated fibrous sheet is then immersed in a non-solvent such as water to solidify the resin component. In the dry process, a fibrous substrate is impregnated with either a solution of a resin component dissolved in an organic solvent or an emulsion of the resin component dispersed in water, and then the resulting impregnated fibrous sheet is dried to solidify the resin component.

The wet process makes it possible to obtain a sheet having a hand feel property more similar to that of natural leather than the dry process, but the wet process suffers from poor productivity. Another problem with the wet process is that harmful organic solvents, such as dimethylformamide, are indispensable. On the other hand, such harmful organic solvents are not required for the resin emulsions which may be used in the dry process. However. the hand feel of sheets made by the dry process is far poorer than that of sheets made by the wet process. This is because in sheets prepared by the dry process, the resin moves in the fibrous substrate during the drying step, to produce a structural form in which fibers are strongly restrained in localized regions, thereby causing the softness of the sheet to be lost and making its hand feel hard. If the amount of adhesion of the resin to the fibers is reduced so as not to damage the flexibility of the sheet, the hand feel is that of the fibrous substrate, such as a nonwoven fabric, and thus a leather-like hand feel cannot be obtained. However, if the amount of adhesion of the resin is increased so as to obtain fulfillment feeling and a leather-like hand feel, the softness of the sheet is reduced, and therefore the sheet becomes hard. In either case, it is impossible to obtain a high-grade hand feel like that of natural leather. This is true in a dry process using either a resin emulsion or organic solvent solutions of the resin.

In the dry process, it may be possible to add a softener subsequent to the addition of the resin in order to improve the softness of the leather-like sheet. However, this would require the additional step of adding the softener, which would result in reduced productivity. Furthermore, even if a softener is added, it is still difficult to obtain a high-grade hand feel like that of natural leather.

Specific examples of methods in which an emulsion resin was used include a method of impregnating a fabric with a mixed resin emulsion consisting of a polyurethane emulsion and a polyacrylic ester emulsion, then treating the resulting impregnated sheet with hot water to produce a base fabric for artificial leather (Japanese Patent Application Laid-Open No. 128078/1980). In addition, a method of adding a solution of inorganic salts dissolved in an aqueous polyurethane emulsion having an average particle size of 0.1 to 2.0 $\mu$m to a nonwoven fabric sheet comprising a fiber layer made mainly of a microfine fiber having a monofilament fineness of 0.5 denier or less, and then drying the resultant impregnated sheet with heat to produce an artificial leather, was suggested (Japanese Patent Application Laid-Open No. 316877/1994). It is unclear whether the artificial leathers obtained by these methods have sufficiently improved softness and hand feel.

For the above-mentioned reasons, the wet process is currently the exclusive process adopted in the industry for producing artificial leather. The wet process is capable of producing high-quality artificial leather but has the disadvantages of having low productivity and requiring the use of an organic solvent.

However, the dry process does not require the use of any organic solvents. Consequently, the dry process has many benefits, such as being environmentally acceptable, providing a safe working environment, being very simple to operate, and so on. For this reason, there has been strong demand for development of a technique for producing a leather-like sheet that is satisfactorily soft and dense and has high quality, using an aqueous resin emulsion.

A sheet whose fibrous substrate is composed of a microfine fiber has good hand feel like that of natural leather and is used as a so-called high-class suede-like artificial leather. A typical example of a method of producing such sheets includes the method (1) of:

(a) impregnating a fibrous substrate comprised of a sea-island type microfine fiber forming composite spun fiber or blend spun fiber, with an organic solvent solution of a resin, (b) wet-solidifying the resin, (c) forming the microfine fiber by dissolving and removing and/or decomposing and removing the sea component with an organic solvent, an alkali solution, or the like, leaving behind the island component of the sea-island type fiber as a microfine fiber. Alternatively, another example of a method for producing such sheets, method (2), includes:

(a) forming a substrate comprising an already formed microfine fiber, (b) impregnating the substrate with an organic solvent solution of a resin, and (c) wet-solidifying the resulting resin saturated substrate.

However, such methods also have the above-discussed problems. If the amount of adhesion of the resin to the fiber is low enough so that the hand feel is soft, the resulting sheet has the hand feel properties of the fibrous substrate, which is not dense.

In light of this background, there is a strong demand for methods of making leather-like sheets using an environmentally acceptable aqueous resin emulsion which provides a safe working environment, and a simple production process. This process should also be capable of using fibrous substrates comprising a microfine fiber and capable of producing a high-quality leather-like sheet having excellent softness and fulfillment feeling.

SUMMARY OF THE INVENTION

An object of the present invention is to provide leather-like sheets that have excellent softness and fulfillment feeling, and have good hand feel, hand feel and physical properties like&those of natural leather and high quality suede, by a process which uses a specific resin emulsion.

The inventors have found that if a specific composite resin emulsion capable of being thermally gelled is used as a resin emulsion to impregnate a fibrous substrate, and the emulsion is then gelled, the resulting composite resin is solidified without restraining the fibers and the resin fills in between the fibers. The inventors also have found that such composite resin emulsions make it possible to provide a high quality leather-like sheet that has excellent softness and fulfillment feeling, and has very good hand feel, feel and physical properties like those of natural leather.

Furthermore, the inventors have found that if a fibrous substrate comprised of a microfine fiber-forming fiber is impregnated with an emulsion of a thermally gellable composite resin, which also has other specific physical properties, and then the emulsion is solidified, and the microfine fiber-forming fiber is subsequently converted into a microfine fiber, it is possible to obtain a leather-like sheet that has high softness and density and has physical properties like that of natural leather and high quality equal to that of sheets obtained by the wet process. That is, the inventors have found that by using the specific thermally gellable emulsion of the present invention, and converting, after the addition of the resin, the microfine fiber-forming fiber of the fibrous substrate into a microfine fiber, the fibrous substrate is impregnated with the resin in such a way that the resin does not restrain the microfine fiber inside the substrate, thereby maintaining appropriate fiber spaces, and subsequently the resin is solidified to supply a leather-like sheet that is highly soft and dense and has high quality.

The present invention is a process for producing a leather-like sheet comprising:

impregnating a fibrous substrate with a thermally gellable composite resin emulsion obtained by emulsion polymerizing an ethylenically unsaturated monomer (B) in the presence of a polyurethane emulsion (A) such that the weight ratio of polyurethane in emulsion (A) to monomer (B) is from 90/10 to 10/90, solidifying the emulsion in the impregnated fibrous substrate by heating, and if the fibrous substrate comprises a microfine fiber-forming fiber, converting the microfine fiber-forming fiber into a microfine fiber bundle, thereby producing a leather-like sheet.

The resin component of the composite resin emulsion used in this process should have the following properties:

(i) a 100 $\mu$m thick resin film, obtained by drying the composite resin emulsion at 50° C., has an elastic modulus at 90° C. of $5.0\times10^8$ dyn/cm$^2$ or less;

(ii) if leather-like sheet employs a fibrous substrate which is not composed of microfine fiber-forming fibers, the elastic modulus of a 100 $\mu$m thick resin film, obtained by drying the composite resin emulsion at 50° C., has an elastic modulus at 90° C. of $1.0\times10^7$ dyn/cm$^2$ or more;

(iii) if the fibrous substrate of the leather-like sheet is composed of microfine fiber-forming fibers, a 100 $\mu$m thick film, obtained by drying the composite resin emulsion at 50° C., has an elastic modulus at 160° C. of $5.0\times10^6$ dyn/cm$^2$ or more.

The composite resin emulsion is an emulsion that can be obtained by emulsion-polymerizing an ethylenically unsaturated monomer (B) in the presence of a polyurethane-based emulsion (A) such that the weight ratio of polyurethane in emulsion (A) to monomer (B) is from 90/10 to 10/90.

A preferred process for producing the composite resin emulsion comprises emulsion-polymerizing an ethylenically unsaturated monomer (B) in the presence of a polyurethane-based emulsion (A), wherein the polyurethane-based emulsion satisfies the following requirements ①–③:

① the polyurethane-based emulsion is prepared by reacting an isocyanate terminated urethane prepolymer with a chain extender in the presence of a surfactant in an aqueous solution, ② the polyurethane-based emulsion has, in its polyurethane skeleton, from 5 to 25 mmol of neutralized carboxylic groups and/or sulfonic groups per 100 g of the polyurethane, and ③ the polyurethane-based emulsion has from 0.5 to 6 g of the surfactant per 100 g of the polyurethane.

DETAILED DESCRIPTION OF THE PREFERRED EMBODIMENTS

The fibrous substrate used in the present invention is any fibrous substrate having the appropriate thickness and fulfillment feeling and having a soft hand feel. The fibrous substrate may be any fibrous substrate, for example, a nonwoven fabric or a woven/knitted fabric, and including fibrous substrates which have been used in the conventional processes for producing leather-like sheets. Preferred fibrous substrates include a fibrous substrate made only of a nonwoven fabric, and a multi-layer product which is made of a nonwoven fabric and a woven fabric and/or a knitted fabric and which has, on at least one surface, a layer of the nonwoven fabric (for example, a two-layer structure composed of a nonwoven fabric layer and a knitted/woven fabric, and a three-layer structure composed of a knitted/woven fabric sandwiched between nonwoven fabrics). More preferable is a fibrous substrate made only of a nonwoven fabric. The nonwoven fabric preferably used as the fibrous substrate may be a fiber-entangled nonwoven fabric or a lap type nonwoven fabric. A fiber-entangled nonwoven fabric is most preferred.

Examples of the fiber which makes up the fibrous substrate include synthetic fibers such as polyester-based, polyamide-based, acrylic-based, polyolefin-based, polyvinyl chloride-based, polyvinylidene chloride-based, and polyvinyl alcohol-based fibers; and natural fibers such as cotton, wool and hemp. Fibrous substrates made mainly of synthetic fibers -such as polyester-based, polyamide-based and acrylic-based fibers are most preferred.

The above-mentioned fiber which makes up the fibrous substrate may be any one selected from ordinary fibers which do not cause shrinkage or extension, shrinkable fibers, potentially spontaneously-extendable fibers, various composite fibers (for example, multilayer-laminating type potentially separable composite fibers), blend spun fibers, microfine fibers, fibers in the form of a bundle, special porous fibers and the like.

The thickness of the fiber which makes up the fibrous substrate is not especially limited and may be selected in accordance with the requirements of the resulting leather-like sheet. In general, the monofilament fineness of the fiber is preferably within the range of 0.01to 10 deniers, including 0.02, 0.04, 0.08, 0.10, 0.15, 0.20, 0.30, 0.40, 0.50, 0.60, 0.70, 0.80, 0.90, 1, 2, 3, 4, 5, 6, 7, 8, and 9 deniers, inclusive of all values and subranges therebetween, and more preferably within the range of 0.02 to 8 deniers.

The thickness of the fibrous substrate is not especially limited and may be selected in accordance with uses of the resultant leather-like sheet. From the viewpoint of hand feel. the thickness is preferably within the range of 0.3 to 3.0 mm, including 0.4, 0.5, 0.6, 0.7, 0.8, 0.9, 1.0, 1.2, 1.4, 1.6, 1.8, 2.0, 2.2, 2.4, 2.6, and 2.8 mm, inclusive of all values and subranges therebetween, and more preferably within the range of 0.8 to 2.5 mm.

The apparent density of the fibrous substrate is preferably within the range of 0.1 to 0.5 g/cm$^3$, including 0.15, 0.20, 0.25, 0.30, 0.35, 0.40, and 0.45 g/cm$^3$, inclusive of all values and, subranges therebetween, and more preferably within the range of 0.15 to 0.45 g/cm$^3$, because it is possible to obtain a leather-like sheet having soft hand feel, appropriate firmness-feeling and water repellency. If the apparent density of the fibrous substrate is less than 0.1 g/cm$^3$, the water repellency and the firmness-feeling of the resultant leather-like sheet are poor and a hand feel like that of natural leather is not obtained. On the other hand, if the apparent density of the fibrous substrate is more than 0.5 g/cm$^3$, the firmness-feeling of the resultant leather-like sheet is lost, or the leather-like sheets feel like rubber.

Above all, the fibrous substrate used in the present invention is preferably a nonwoven fabric which has an apparent density of 0.25–0.50 g/cm$^3$, and at least one part of which is composed of a shrinkable polyethylene terephthalate fiber. If such a fibrous substrate is used, it is possible to obtain a leather-like sheet having very good softness and firmness-feeling. When the fibrous substrate is made up of a shrinkable polyethylene terephthalate fiber, the preferred polyethylene terephthalate fiber is one having a shrinkage percentage of 10–60% in 70° C. hot water. The above-mentioned nonwoven fabric may be obtained by shrinking, in hot water, the nonwoven fabric disclosed in Laid-Open Japanese Patent Application Nos. 373,53/1981 and 53388/1978, in which an ordinary polyester fiber is blended together with a potentially spontaneously-extendable fiber at an appropriate ratio, and subsequently thermally dried for the purpose of spontaneous extension.

It is preferable that the above-mentioned fibrous substrate is pretreated with a fiber treating agent capable of blocking the adhesion between the fiber and the composite resin. By impregnating a fibrous substrate pretreated with a fiber treating agent with the specific composite resin emulsion used in the present invention and solidifying the resin, the composite resin does not restrain the fibers as strongly, making it easier to obtain a leather-like sheet that is very soft and dense and feels like natural leather.

The fiber treating agent for blocking the adhesion between the fiber and the composite resin may be preferably a silicone-based, softening, water-repellent compound. Specific examples of such silicone-based, softening, water-repellent compounds include dimethylsilicone oil (dimethylpolysiloxane oil), methylphenylsilicone oil (methylphenylpolysiloxane oil), methylhydrogensilicone oil (methylhydrogenpolysiloxane oil, polysiloxane oils having a methylhydrogensiloxy unit and a dimfethylsiloxy unit, or a mixture thereof), diorganopolysiloxane diol, fluorosilicone oil, silicone polyether copolymer, alkyl-modified silicone oil, higher fatty acid-modified silicone oil, amino-modified silicone oil and epoxy-modified silicone oil. One or more of such fiber treating agents may be used.

Among the above-mentioned silicone-based, softening, water-repellent compounds, mixtures of dimethylsilicone oil and methylhydrogensilicone oil are preferred because they are very effective at blocking the adhesion between the fiber and the composite resin, and are readily available. As the number of Si-H bonds increases in the above-mentioned silicone oils, the water-repellency of the resulting leather-like sheet becomes higher and the baking temperature required to produce it can be reduced. Therefore, when the methylhydrogensilicone oil is blended with a dimethylsilicone oil, and the methylhydrogensilicone oil is a polysiloxane having an methylhydrogensiloxy unit and a dimethylsiloxy unit, it is preferable that this polysiloxane have 60mole % or more of the metiylhydrogensiloxy unit. The weight ratio of the dimethylsilicone oil to methylhydrogensilicone oil is preferably from 1/9 to 9/1. If the amount of dimethylsilicone oil is less than 10% by weight of the total amount of silicone oil, the hand feel of the resultant leather-like sheet tends to become hard. On the other hand, If the amount of methylhydrogensilicone oil is less than 10% by weight of the total amount of silicone oil, the water-repellency of the resultant leather-like sheet tends to become insufficient.

The silicone-based, softening, water-repellent compounds are an oil type, an emulsion type, a solution type or the like. In the present invention, any one of them may be used. For industrial use, the emulsion type, in which a silicone compound is emulsified or dispersed in water, is preferred. In order to give high water-repellency to the fibrous substrate at low temperatures, a metal salt catalyst, such as a tin, titanium, zirconium or zinc salt of an organic acid, may be added to the silicone-based, softening, water-repellent compound.

The method for adding the above-mentioned fiber treating agent to the fibrous substrate may be any one of various methods of adding the fiber treating agent homogeneously to the fibrous substrate. Above all, for example, when the fiber treating agent is a silicone-based, softening, water-repellent compound, it is preferable to adopt a method of diluting this compound with water to prepare an aqueous liquid having a concentration of 0.5–5%.by weight of the silicone-based, softening, water-repellent compound, optionally adding a catalyst to the liquid to prepare a treating liquid, immersing the fibrous substrate in the liquid, removing the fibrous substrate from the liquid, squeezing the substrate to adjust the amount of the silicone-based, softening, water-repellent compound retained in the fibrous substrate, optionally pre-drying the substrate, and heating/drying it, or the like method. In order to cause the silicone-based, softening, water-repellent compound to adhere strongly to the fibrous substrate, the heating/drying temperature is preferably from 50 to 150° C. .

The amount (after heating/drying) of the fiber treating agent adhering to the fibrous substrate is preferably from 0.05 to 5% by weight and more preferably from 0.3 to 3% by weight, including 0.10, 0.20, 0.30, 0.40, 0.50, 0.60, 0.70, 0.80, 0.90, 1, 2, 3, and 4% by weight, inclusive of all values and subranges therebetween. If the amount of the fiber treating agent adhering to the substrate is less than 0.05% by weight, the resultant leather-like sheet tends to have insufficient softness and water-repellency. On the other hand, if the amount of fiber treating agent adhering to the substrate is more than 5% by weight, the fiber treating agent bleeds out onto the surface of the leather-like sheet and tends to cause deterioration of the feel of the surface, poor surface appearance, and adhesion of the fiber treating agent to other surfaces.

To improve washing-resistance of the leather-like sheet, the fibrous substrate may be optionally subjected to pretreatment with a urethane resin, melamine resin, ethylene urea resin, glyoxal resin or the like.

In addition to the above-mentioned fibers, a microfine fiber-forming fiber is more preferred. When the fibrous substrate comprises such a microfine fiber-forming fiber, the method of impregnating such a fibrous substrate with the composite resin emulsion, solidifying the resin, and converting the microfine fiber-forming fiber into a microfine fiber to prepare a leather-like sheet may be used. This method provides a leather-like sheet with improved softness, fulfillment feeling, and hand feel like that of natural leather.

The microfine fiber-forming fiber used in this method is preferably a microfine fiber-forming composite spun fiber and/or blend spun fiber comprising two or more polymers. The fibrous substrate can be made to have a microfine fiber structure in the leather-like sheet by dissolving and/or decomposing a portion of the polymers which make the composite spun fiber and/or the blend spun fiber, thereby removing a portion of the polymer, and leaving the remaining polymer as the microfine fiber.

Typical examples of the microfine fiber-forming composite spun fiber and/or blend spun fiber comprising two or more polymers are a sea-island type composite spun fiber and a sea-island blend spun fiber comprising two or more polymers. The island component of the microfine fiber-forming fiber can be converted to a microfine form by dissolving and removing the polymer which makes the sea component with an organic solvent, an alkali solution, water or the like, so that a microfine fiber is prepared. The fibrous substrate used in the present invention may be made from one or both of the sea-island type composite spun fiber and the sea-island type blend spun fiber.

Examples of the polymers which may be used to make the sea-island type composite spun fiber and the sea-island type blend spun fiber include polyesters such as polyethylene terephthalate, polybutylene terephthalate and modified polyesters; polyamides such as nylon-6, nylon-6,12, nylon-6,6, and modified nylons; polyolefins such as polyethylene and polypropylene; polystyrene; polyvinylidene chloride; polyvinyl acetate; polymethacrylates; polyvinyl alcohol; and polyurethane elastomers. By selecting two or more polymers having different solubilities in an organic solvent, an alkali solution, water or the like, it is possible to obtain a microfine fiber-forming sea-island type composite spun fiber and sea-island blend type spun fiber wherein the island component can remain in a microfine fiber form upon removal of the sea component by dissolution or decomposition. The island component may be made of only one polymer, or two or more polymers. When the island component is made of two or more polymers, two or more microfine fibers are present in the fibrous substrate after conversion of the composite spun fiber or blend spun fiber into a microfine fiber by the above-described process.

The weight ratio of the island component to the sea component in the microfine fiber-forming sea-island type composite spun fiber and sea-island type blend spun fiber is limited to a specific range. The weight ratio of the island component to the sea component is preferably from 15/85 to 85/15, and more preferably from 25/75 to 75/25, from the standpoint of ease of production of the composite spun fiber or the blend spun fiber, ease of microfine-fiber conversion, and imparting good physical properties to the resultant leather-like sheet.

In the microfine fiber-forming sea-island type composite spun fiber or sea-island type blend spun fiber, the number of the island components, the fineness thereof, the dispersion state, of the island component in the sea component, and the like are not especially limited. The microfine fiber-forming sea-island type composite spun fiber or sea-island type blend spun fiber may have any such morphology which allow reproduction of the fibrous substrate comprising a microfine fiber.

The following leather-like sheet is especially preferred as a raw material for artificial leather since it has excellent softness and fulfillment feeling, and a good hand feel like that of natural leather. This especially preferred leather-like sheet is obtained by impregnating a fibrous substrate made from a sea-island type composite spun fiber or sea-island type blend spun, fiber whose sea component is polyethylene and/or polystyrene and whose island component is polyester and/or polyamide, with a composite resin emulsion, solidifying the resin, dissolving and removing the polyethylene and/or the polystyrene sea component(s) with an organic solvent, for example, an aromatic hydrocarbon solvent such as benzene, toluene or xylene, or halogenated hydrocarbon such as carbon tetrachloride or perchloroethylene, in particular toluene, to cause the polyester and/or the polyamide island(s) to rermain in a microfine fiber form.

The fibrous substrate comprising the microfine fiber-forming fiber used in the present invention may be made using the above-mentioned microfine fiber-forming fiber, together with other optional fiber materials, provided the hand feel of the resultant leather-like sheet is not degraded. Examples of the other fiber materials include ordinary fibers, shrinkable fibers, potentially spontaneously-extendable fibers, multilayer-laminating type potentially- separable fibers, and special porous fibers. One or more of these may be used. The other fibers may also be synthetic fibers such as polyester-based, polyamide-based, acrylic-based, polyolefin-based, polyvinyl chloride-based, polyvinylidene chloride-based and polyvinyl alcohol-based fibers; semisynthetic fibers; and natural fibers such as cotton, wool and hemp.

The monofilament fineness of the microfine fiber obtained from the microfine fiber-forming fiber which makes the fibrous substrate is preferably 0.5 denier or less and more preferably from 0.001 to 0.4 denier, including 0.002, 0.004, 0.006, 0.008, 0.01, 0.02, 0.03, 0.04, 0.05, 0.06, 0.07, 0.08, 0.09, 0.1, 0.2, and 0.3 denier, inclusive of all values and subranges therebetween, since the fineness makes it possible to obtain a leather-like sheet having excellent softness, fulfillment feeling, and a hand feel like that of natural leather.

As for the above-mentioned ordinary fiber (that is, a fiber which is not a microfine fiber-forming fiber), the thickness of the fibrous substrate comprising the microfine fiber-forming fiber may be selected at will in accordance with the anticipated uses of the resultant leather-like sheet. The thickness before the impregnation with the composite resin emulsion is preferably from 0. 3 to 3. 0 mm, including 0.4, 0.5, 0.6, 0.7, 0.8, 0.9, 1.0, 1.2, 1.4, 1.6, 1.8, 2.0, 2.4, 2.6, and 2.8, inclusive of all values and subranges therebetween, and more preferably from 0.6 to 2.5 mm since the thickness of the fibrous substrate makes it possible for the resulting leather-like sheet to have an appropriate hand feel like that of leather.

In order to provide a soft leather-like sheet, the apparent density of the fibrous substrate comprising the microfine fiber-forming fiber is preferably from 0.1 to 0.5 g/cm$^3$ and more preferably from 0.15 to 0.45 g/cm$^3$ when the fiber in the fibrous substrate is in a microfine fiber form (for example, when the sea component has been removed from the above-mentioned sea-island type composite spun fiber and/or blend spun fiber to prepare a microfine fiber). If the apparent density of the fibrous substrate is less than 0.1 g/cm$^3$, the water repellency and the firmness-feeling of the resultant leather-like sheet are poor, and the hand feel is less like that of natural leather. On the other hand, if the apparent density of the fibrous substrate is more than 0.5 g/cm$^3$, the firmness-feeling of the resultant leather-like sheet is lost or a bad hand feel like that of rubber tends to be exhibited.

In order to homogeneously and quickly impregnate the fibrous substrate comprising the microfine fiber-forming fiber with the composite resin emulsion, the fibrous substrate may also be treated with an aqueous solution or aqueous emulsion of a surfactant exhibiting moist permeability to the fibrous substrate, before the fibrous substrate is impregnated with the composite resin emulsion. In this case, it is necessary to perform the impregnation with the composite resin emulsion without drying and/or removing the solvent of the aqueous dispersion or emulsion of the surfactant, from the fibrous substrate. If the fibrous substrate is completely dried after being treated with an aqueous solution or aqueous emulsion of a surfactant, the homogeneous and rapid impregnation of the substrate with the composite resin emulsion cannot be expected. The amount of surfactant added to the fibrous substrate is preferably from 0.01 to 20% by weight of the fibrous substrate, including 0.02, 0.03, 0.04, 0.05, 0.06, 0.07, 0.08, 0.09, 0.10, 0.15, 0.20, 0.25, 0.30, 0.35, 0.40, 0.45, 0.50, 0.55, 0.60, 0.65, 0.70, 0.75, 0.80, 0.85, 0.90, 0.95, 1, 2, 5, 10, 15, and 19% by weight of the fibrous substrate, inclusive of all values and subranges therebetween. When the fiber is a microfine fiber-forming fiber, it is unnecessary to add any fiber treating agent which blocks the adhesion between the fiber and the composite resin, before the addition of the composite resin emulsion. This is because the sea component of the microfine fiber-forming fiber is removed after the impregnation with the composite resin emulsion, which necessarily produces spaces between the fiber and the composite resin.

Next, the fibrous substrate is impregnated with the thermally gellable composite resin emulsion and then the resin is solidified. The thermal gelation property referred to in the present invention is the property of a fluid emulsion which gels upon heating to form a solid material. The thermal gelation temperature is the temperature at which the composite resin emulsion turns into a solid gel, thereby losing the fluidity of the composite resin emulsion. The thermal gelation temperature is preferably from 30 to 70° C. and more preferably from 40 to 70° C., including 35, 40, 45, 50, 55, 60, and 65° C., inclusive of all values and subranges therebetween.

If the composite resin emulsion does not have this thermal gelation property, upon impregnation of the fibrous substrate with the composite resin emulsion and drying of the emulsion with hot air, the particles of the emulsion can move inside the fibrous substrate. Thus, the composite resin cannot be homogeneously dispersed or added into the fibrous substrate. This causes physical properties, such as the stretch and softness of the leather-like sheet to drop, and its hand feel to become poor. If the fibrous substrate impregnated with a composite resin emulsion which is not thermally gellable is solidified in hot water, the emulsion may flow out into the hot water. As with the hot air dried emulsions, above, this also tends to prevent the composite resin from being homogeneously dispersed or added into the fibrous substrate, and also causes deterioration of physical properties, such as stretch and softness of the leather-like sheet, as well as the hand feel of the resulting leather-like sheet.

The thermally gellable composite resin emulsion may be an emulsion comprising a composite resin having the thermal gelation property by itself, or a composite resin emulsion in which a thermal gelling agent is added to the emulsion so as to provide the thermal gelation property.

Examples of the thermal gelling agents include inorganic salts, polyethylene glycol type nonionic surfactants, polyvinylmethyl ethers, polypropylene glycols, silicone polyether copolymers, and polysiloxanes, including mixtures thereof.

A combination of an inorganic salt and a polyethylene glycol type nonionic surfactant is a preferred thermal gelling agent, since it exhibits good thermal gelation properties. The inorganic salt in this case is preferably a monovalent or divalent metal salt that lowers the cloud point of the polyethylene glycol type nonionic surfactant. Specific examples include one or more of sodium carbonate, sodium sulfate, calcium chloride, calcium sulfate, zinc oxide, zinc chloride, magnesium chloride, potassium chloride, potassium carbonate, sodium nitrate, and lead nitrate. Specific examples of the polyethylene glycol type nonionic surfactants include ethylene oxide adducts of higher alcohols, ethylene oxide adducts of alkylphenols, ethylene oxide adducts of fatty acids, ethylene oxide adducts of fatty acid esters of polyvalent alcohols, ethylene oxide adducts of higher alkylamines and ethylene oxide adducts of polypropylene glycol, including mixtures thereof. When an emulsion containing a thermal gelling agent is used, the amount of the thermal gelling agent is preferably from 0.2 to 20 parts by weight per 100 parts by weight of the resin in the emulsion, including 0.3, 0.4, 0.5, 0.6, 0.7, 0.8, 0.9, 1, 2, 3, 4, 5, 6, 7, 8, 9, 10, 11, 12, 13, 14, 15, 16, 17, 18, and 19parts by weight, inclusive of all values and subranges therebetween.

A 100 $\mu$m thick resin film, obtained by drying the composite resin emulsion used in the present invention at 50° C., has an elastic modulus at 90° C. of $5.0\times10^8$ dyn/cm$^2$ or less preferably $3.0\times10^8$ dyn/cm$^2$ or less and more preferably $2.0\times10^8$ dyn/cm$^2$ or less. If the leather-like sheet employs a fibrous substrate which is not composed of microfine fiber-forming fibers, the elastic modulus of a 100 $\mu$m thick resin film, obtained by drying the composite resin emulsion at 50° C., is $1.0\times10^7$ dyn/cm$^2$ or more, preferably $1.5\times10^7$ dyn/cm$^2$ or more. If the composite resin emulsion is composed of a resin having an elastic modulus at 90° C., as described above, of more than $5.0\times10^8$ dyn/cm$^2$, the resultant leather-like sheet has poor softness and a hard hand feel. If the composite resin emulsion is composed of a resin having an elastic modulus at 90° C., as described above, of less than $1.0\times10^7$ dyn/cm$^2$, for leather-like sheets in which the fibrous substrate does not contain microfine fiber-forming fibers, the fibers in the leather-like sheet are strongly restrained by the composite resin. As a result, the sheet has a poor hand feel like that of the fiber, which is neither dense nor like that of natural leather.

When the fibrous substrate is composed of a microfine fiber-forming fiber, a composite resin emulsion that supplies a 100 $\mu$m thick dried film having an elastic modulus at 90° C. of $5.0\times10^6$ dyn/cm$^2$ or more is preferred.

When the fibrous substrate is composed of a microfine fiber-forming fiber, a 100 $\mu$m thick film, obtained by drying the composite resin emulsion at 50° C., should have an elastic modulus at 160° C. of $5.0\times10^6$ dyn/cm$^2$ or more, preferably $8.0\times10^6$ dyn/cm$^2$ or more, and more preferably $1.0\times10^7$ dyn/cm$^2$ or more. If the leather-like sheet employs a composite resin emulsion that supplies the dried film having an elastic modulus at 160° C. of less than $5.0\times10^6$ dyn/cm$^2$, the fibrous substrate may become compressed or thinned due to, for example, the pressure from a squeezing roller used during the impregnation of the fibrous substrate with the composite resin emulsion, the solidification of the resin, and the extraction/removal of the sea component of the sea-island type composite or blend spun fiber making up the fibrous substrate. That is, so-called "settling" occurs. As a result, the fibrous substrate has poor hand feel which causes a loss of softness, fulfillment feeling, firmness-feeling and the like. In the present invention, the method for measuring the elastic moduli at 90° C. and 160° C. of the above-mentioned dried films made from the composite resin emulsion is described in the Examples.

The 100 μm thick resin films, obtained by drying the composite resin emulsion as described above, have α dispersion temperatures (Tα) of preferably −10° C. or lower and more preferably −20° C. or lower. If the dried film obtained from the composite resin emulsion has Tα of −10° C. or lower, the resultant leather-like sheet has excellent physical properties such as cold-resistance, and bending-resistance. The method for measuring the Tα of the dried film in the present invention is described in the Examples.

The composite resin emulsion used in the present invention can be produced by emulsion-polymerizing an ethylenically unsaturated monomer (B) in the presence of a polyurethane emulsion (A) such that the weight ratio of polyurethane in the component (A) to the (B) component is from 90/10 to 10/90.

The polyurethane component of the polyurethane emulsion (A) can be generally obtained by reacting a macromolecular polyol, an organic diisocyanate compound, and a chain extender.

Examples of the macromolecular polyols used in the production of the polyurethane include polyester polyols, polyether polyols, polycarbonate polyols, and polyester polycarbonate polyols. The polyurethane can be prepared by using one or more of these macromolecular polyols.

The polyester polyol can be produced, by subjecting, for example, an ester-forming derivative such as a polycarboxylic acid, an ester thereof or an anhydride thereof to direct esterification or transesterification with a polyol component in a conventional manner. The polyester polyol may also be produced by subjecting a lactone to ring-opening polymerization.

The polycarboxylic acid may be any one that is generally used in the production of polyester. Examples include aliphatic dicarboxylic acids having 4–12 carbon atoms such as succinic acid, glutaric acid, adipic acid, pimelic acid, suberic acid, azelaic acid, sebacic acid, dodecane diacid, methylsuccinic acid, 2-methylglutaric acid, 3-methylglutaric acid, trimethyladipic acid, 2-methyloctane diacid, 3,8-dimethyldecane diacid, 3,7-dimethyldecane diacid; alicyclic dicarboxylic acids such as cyclohexane dicarboxylic acid; aromatic dicarboxylic acids such as terephthalic acid, isophthalic acid, orthophthalic acid, naphthalene dicarboxylic acid; tricarboxylic acids such as trimellitic acid and trimesic acid; and ester-forming derivatives thereof. The polyester polyol can be prepared by using one or more of the above-mentioned polycarboxylic acid components. Above all, the polyester polyol is preferably a polyester polyol prepared by using an aliphatic dicarboxylic acid or an ester-forming derivative thereof as the polycarboxylic acid component.

Examples of the polyol component of the polyester polyol used in the production of the polyurethane include aliphatic diols having 2–15 carbon atoms such as ethylene glycol, diethylene glycol, triethylene glycol, propylene glycol, 1,3-propanediol, 2-methyl-1,3-propanediol, 2,2-diethyl 1,3-propanediol, 1,3-butylene glycol, 1,4-butanediol, 3-methyl 1,5-pentanediol, 1,6-hexanediol, 1,8-octanediol, 2-methyl-1,8-octanediol, 2,7-dimethyl-1,8-octanediol, 1,9-nonanediol, 2,8-dimethyl- 1,9-nonanediol, 1,10-decanediol; alicyclic diols such as 1,4 - cyclohexanediol, cyclohexanedimethanol and dimethylcyclooctane dimethanol; aromatic diols such as 1,4 -bis (β-hydroxyethoxy) benzene; polyalkylene glycols; polyols such as glycerin, trimethylolpropane, butanetriol and pentaerythritol. One or more thereof can be used. Above all, the polyester polyol is preferably any polyester polyol prepared using an aliphatic polyol.

Examples of lactones that may be a raw material of the polyester polyol used in the production of the polyurethane are, for example, ε-caprolactone, or β-methyl-δ-valerolactone.

Examples of the polyether polyol that can be used in the production of the polyurethane include polyethylene glycol, polypropylene glycol, polytetramethylene glycol, and poly (methyltetramethyleneglycol). One or more thereof may be used.

The polycarbonate polyol that can be used in the production of the polyurethane may be, for example, any polycarbonate polyol obtained by reacting a polyol with a carbonate compound such as a dialkyl carbonate, diaryl carbonate or alkylene carbonate. The polyols that may be a raw material of the polycarbonate polyol can include any polyol which may be used to prepare the polyester polyol, above. The dialkyl carbonate may be dimethyl carbonate, diethyl carbonate or the like. The diaryl carbonate may be diphenyl carbonate or the like. The alkylene carbonate may be ethylene carbonate or the like.

The polyester polycarbonate polyol that may be used in the production of the polyurethane may be, for example, one obtained by reacting a polyol, polycarboxylic acid and a carbonate compound simultaneously, one obtained by reacting previously prepared polyester polyol with a carbonate compound, one obtained by reacting previously prepared polycarbonate polyol with polyol and polycarboxylic acid, or one obtained by reacting a previously prepared polyester polyol with a previously prepared polycarbonate polyol.

The number-average molecular weight of the macromolecular polyol used in the production in the polyurethane is preferably from 500 to 10,000, more preferably from 700 to 5,000, and still more preferably from 750 to 4,000. The number-average molecular weight of the macromolecular polyol the number-average molecular weight calculated on the basis of the hydroxyl value measured according to JIS K 1577.

In the macromolecular polyol used in the production of the polyurethane, the number of hydroxyl groups per molecule may be more than 2, unless the number of hydroxyl groups per molecule is so high as to hinder the production of the polyurethane emulsion (A). The macromolecular polyol having more than 2 hydroxyl groups per molecule, for example a polyester polyol, can be produced by using, at least in part, polyols such as glycerin, trimethylolpropane, butanetriol, hexanetriol, trimethylolbutane or pentaerythritol.

The organic diisocyanate compound used in the production of the polyurethane is not especially limited, and may be any one of the known aliphatic diisocyanates, alicyclic diisocyanates and aromatic diisocyanates that have been used in the production of a polyurethane emulsion. Specific examples of these organic diisocyanate compounds include isophorone diisocyanate, tolylene diisocyanate, 4,41-diphenylmethane diisocyanate, p-phenylene diisocyanate, 1,5-naphthylene diisocyanate, xylylene diisocyanate, hexamethylene diisocyanate, 4,4'-dicyclohexylmethane diisocyanate, 3,3'-dichloro4,4'-diphenylmethane diisocyanate, and hydrogenated xylylene diisocyanate. One or more of these organic diisocyanates may be used.

When the fibrous substrate is made of a microfine fiber-forming fiber, aromatic diisocyanates, such as tolylene diisocyanate or 4,4'-diphenylmethane diisocyanate are preferred, since the resulting polyurethanes have excellent solvent resistance. Leather-like sheets made with the composite resin emulsion containing a polyurethane made using such an aromatic diisocyanate, exhibit a lower drop in the physical properties of the composite resin because of the excellent resistance of the composite resin to organic solvents. Thus, it is possible to obtain a leather-like sheet having excellent hand feel and mechanical properties.

When the fibrous substrate does not contain any microfine fiber-forming fibers, isophorone diisocyanate, tolylene diisocyanate, 4,4'-diphenylmethane diisocyanate or 4,4'-dicyclohexylmethane diisocyanate are especially preferred diisocyanates.

The chain extender used in the production of the polyurethane may be any of the chain extenders that have been used in the production of polyurethane-based emulsion. Low molecular weight compounds having two or more active hydrogen atoms that can be reacted with isocyanate groups, and which have a molecular weight of 400 or less are especially preferred. Examples of such chain extenders include diamines such as hydrazine, ethylenediamine, propylenediamine, isophoronediamine, piperazine and derivatives thereof, phenylenediamine, toluenediamine, xylylenediamine, adipic dihydrazide, isophthalic dihydrazide, hexamethylenediamine, 4,4'-diaminodiphenylmethane, 4,4'-dicyclohexylmethanediamine; triamines such as diethylenetriamine; diols such as ethylene glycol, propylene glycol, 1,4-butanediol, 1,6-hexanediol, 3-methyl1,5-pentanediol, neopentylglycol, 1,4-cyclohexanediol, bis-(p-hydroxylethyl)terephthalate, xylylene glyxol, 1,4-bis(β-hydroxyethoxy) benzene; and aminoalcohols such as aminoethyl alcohol and aminopropyl alcohol. One or more thereof may be used. Ethylene glycol, isophoronediamine, ethylenediamine, diethylenetriamine or the like are especially preferred.

The polyurethane emulsion (A) preferably has, in its polyurethane skeleton. from 5 to 25 mmol of neutralized carboxylic acid groups or sulfonic acid groups per 100 g of the polyurethane, in order that the emulsion have sufficient stability and good thermal gelation properties. The neutralized carboxylic acid groups or sulfonic acid groups can be introduced into the polyurethane skeleton by using a compound having carboxylic acid groups or sulfonic acid groups or salts of these groups and having one or more active hydrogen atoms, for example a hydroxyl group, an amino group or the like, as one of the raw materials for the production of the polyurethane. Optionally, a base compound such as a tertiary amine or an alkali metal may be used to neutralize the carboxylic acid groups or sulfonic acid groups. Examples of such a compounds include carboxylic acid group-containing compounds such as 2,2-bis(hydroxymethyl)propionic acid, 2,2-bis(hydroxymethyl) butyric acid and 2,2-bis(hydroxylmethyl)valeric acid, and derivatives thereof, sulfonic acid group-containing compounds such as 1,3-phenylenediamine4,6-disulfonic acid and 2,4-diaminotoluene 5-sulfonic acid, and derivatives thereof. Polyester polyols or polyester polycarbonates obtained by copolymerizing the above-mentioned compounds may also be used. A method of using 2,2-bis(hydroxylmethyl)propionic acid or 2,2-bis(hydroxylmethyl) butyric acid to produce a polyurethane prepolymer and adding a base compound such as triethylamine, trimethylamine, sodium hydroxide or potassium hydroxide after the end of the reaction of the prepolymer to neutralize the carboxylic acid groups is especially preferred.

In order to improve the solvent resistance, heat resistance, resistance against hot water and the like, the polyurethane may optionally be reacted with a polyol having tri-or more-functionality, such as trimethylolpropane, or an amine having tri-or more-functionality in order to crosslink the polyurethane.

The polyurethane emulsion (A) used in the present invention may be produced known methods. For example, one method, (1), of producing a urethane prepolymer having a terminal isocyanate group, includes the steps of emulsifying the prepolymer in water using high mechanical shearing forces and in the presence of an emulsifier, and simultaneously or subsequently adding an appropriate chain extender to prepare a polyurethane emulsion having a high molecular weight. A second method, (2), of producing a urethane prepolymer includes using a hydrophilic macromolecular polyol to produce a self-emulsifying polyurethane and emulsifying the polyurethane in water without use of any emulsifier to produce a polyurethane-based emulsion. Emulsifying and/or dispersing equipment such as a homomixer or a homogenizer may be used to assist in the emulsification. In order to suppress the reaction of the isocyanate group with water, the emulsifying temperature is preferably set to 40° C. or lower.

The emulsifier of method (1) preferably comprises 0.5 to 6 g of a surfactant per 100 g of polyurethane because it provides good thermal gelation properties and good polymerization stability upon emulsion-polymerization of the ethylenically unsaturated monomer (B) in the presence of the polyurethane emulsion (A). Examples of such a surfactant include anionic surfactants such as sodium lauryl sulfate, ammonium lauryl sulfate, sodium polyoxyethylenetridecylether acetate, sodium dodecylbenzenesulfonate, sodium alkyldiphenylether disulfonate and sodium di(2-ethylhexyl) sulfosuccinate; and nonionic surfactants such as polyoxyethylene nonylphenyl ether, polyoxyethylene octylphenyl ether, polyoxyethylene lauryl ether, polyoxyethylene stearyl ether, and polyoxyethylene-polyoxypropylene block copolymer. Above all, the anionic surfactants such as sodium lauryl sulfate, sodium polyoxyethylenetridecylether acetate and ammonium lauryl sulfate are preferred.

The composite resin emulsion used in the present invention is produced by emulsion-polymerizing the ethylenically unsaturated monomer (B) in the presence of the polyurethane emulsion (A). The weight ratio of the polyurethane in the polyurethane emulsion (A) to the ethylenically unsaturated monomer (B) is from 90/10 to 10/90, preferably from 85/15 to 15/85 and still more preferably 80/20 to 20/80. If the amount of the polyurethane is less than 10% by weight, the elastic modulus of the composite resin is high, resulting in deterioration of the hand feel of the resulting leather-like sheet. If the amount of the polyurethane is more than 90% by weight, the weather resistance and hydrolysis resistance of the composite resin deteriorate, and the composite resin becomes more expensive.

When the fibrous substrate is composed of microfine fiber-forming fibers, the ethylenically unsaturated monomer (B) preferably comprises 90 to 99.9% by weight of a monofunctional ethylenically unsaturated monomer (B1) made mainly of a derivative of (meth)acrylic acid and 10 to 0. 1% by weight of a polyfunctional (not less than difunctional) ethylenically unsaturated monomer (B2), because of more satisfactory hand feel and weather-resistance of the resulting leather-like sheet. The ethylenically unsaturated monomer (B) more preferably comprises 92 to 99.8% by weight of the monofunctional ethylenically unsaturated monomer (B1 ) and 8 to 0.2% by weight of the polyfunctional ethylenically unsaturated monomer (B2). Even when the fibrous substrate is composed of other than microfine fiber-forming fibers, the monofunctional ethylenically unsaturated monomer (B1) and the polyfunctional ethylenically unsaturated monomer (B2) are preferably used together as the above-mentioned ethylenically unsaturated monomer (B), at the above-mentioned ratio, to improve the endurance of the resulting leather-like sheet.

Examples of the monofunctional ethylenically unsaturated monomer (B1) used in the production of the composite resin emulsion include derivatives of (meth)acrylic acid such as methyl(meth)acrylate, ethyl(meth)acrylate, butyl (meth)acrylate, 2-ethylhexyl(meth)acrylate, lauryl(meth) acrylate, stearyl(meth)acrylate, cyclohexyl(meth)acrylate, isobornyl (meth)acrylate, benzyl (meth)acrylate, (meth) acrylic acid, glycidyl(meth)acrylate, dimethylaminoethyl (meth)acrylate, diethylaminoethyl(meth)acrylate, 2-hydroxyethyl (meth)acrylate and 2-hydroxypropyl (meth) acrylate; aromatic vinyl compounds such as styrene, α-methylstyrene and p-methylstyrene; acrylamides such as acrylamide, diacetone acrylamide, methacrylamide and maleic amide; maleic acid, fumaric acid, itaconic acid and derivatives thereof; heterocyclic vinyl compounds such as vinylpyrrolidone; vinyl compounds such as vinyl chloride, acrylonitrile, vinyl ether, vinyl ketone and vinyl amide; α-olefins such as ethylene and propylene. One or more thereof may be used. The proportion of derivatives of (meth)acrylic acid in the monofunctional ethylenically unsaturated monomer (B1) is preferably 60% or more, more preferably 70% or more and still more preferably 80% or more by weight.

Examples of the polyfunctional (not less than difunctional) ethylenically unsaturated monomer used in the production of the composite resin emulsion include diacrylates such as ethylene glycol di(meth)acrylate, diethylene glycol di(meth)acrylate, triethylene glycol di(meth)acrylate, polyethylene glycol di(meth)acrylate, 1,4-butanediol di(meth)acrylate, 1,6-hexanediol di(meth)acrylate, 1,9-nonanediol di(meth)acrylate, neopentyl glycol di(meth) acrylate, dimethyloltricyclodecane di(meth)acrylate and glycerin di(meth)acrylate; tri(meth)acrylates such as trimethylolpropane tri(meth)acrylate and pentaerythritol tri (meth)acrylate; tetra(meth)acrylates such as pentaerythritol tetra(meth)acrylate; polyfunctional aromatic vinyl compounds such as divinylbenzene and trivinylbenzene; compounds containing two or more ethylenically unsaturated bonds which are different from each other, such as allyl (meth)acrylate and vinyl (meth)acrylate; urethane acrylates having a molecular weight of 1500 or less, such as a 2:1 addition reaction product of 2-hydroxy3-phenoxypropyl acrylate and hexamethylenediisocyanate, a 2:1 addition reaction product of penetaerythritol triacrylate and hexamethylenediisocyanate and a 2:1 addition reaction product of glycerin dimethacrylate and tolylene diisocyanate. One or more thereof may be used.

The ethylenically unsaturated monomer (B) may be added to the polyurethane emulsion (A) collectively, separately or continuously. A multi-step polymerization may be performed in which the composition of monomers is changed in the respective steps of polymerization, or a power feed method may be used in which the composition of monomers is continuously changed. In the multi-step polymerization or polymerization by the power feed method, the total amount of the polyfunctional (not less than difunctional) ethylenically unsaturated monomer (B2) is preferably from 0.1 to 10% by weight of the total amount of the ethylenically unsaturated monomer (B) used in the polymerization. An emulsifier such as a surfactant may be added, as appropriate, upon the polymerization of the ethylenically unsaturated monomer (B).

A method of first emulsion-polymerizing an acrylic acid derivative-based monomer and then emulsion-polymerizing a methacrylic acid derivative-based monomer or an aromatic vinyl monomer is especially preferred because products obtained from the resulting composite resin emulsion have the highly elastic properties of polyurethane. The acrylic acid derivative-based monomer, the methacrylic acid derivative monomer, and the aromatic vinyl monomer used in this method may be any of those mentioned above. The weight ratio of the acrylic acid derivative-based monomer to the methacrylic acid derivative-based monomer or the aromatic vinyl monomer (if the methacrylic acid derivative-based monomer and the aromatic vinyl monomer are used together, the total amount of the two monomers) is from 50/50 to 99/1.

Examples of a polymerization initiator which may be used in the polymerization of the ethylenically unsaturated monomer (B) include oil-soluble peroxides such as benzoylperoxide, lauroylperoxide, dicumylperoxide, di-t-butylperoxide, cumenehydroperoxide, t-butylhydroperoxide, diisopropylbenzenehydroperoxide; oil-soluble azo compounds such as 2,2'-azobisisobutyronitrile and 2,2'-azobis-(2,4-dimethylvaleronitrile: water-soluble peroxides such as hydrogen peroxide, potassium persulfate, sodium persulfate and ammonium persulfate; water-soluble azo compounds such as azobiscyanovaleric acid, 2,21-azobis-(2-amidinopropane)bishydrochloride. One or more of such initiators may be used. Above all, the oil-soluble initiators such as the oil-soluble peroxide and the oil-soluble azo compounds are preferred. Redox initiators employing a reducing agent and an optional chelating agent, together with the above-mentioned polymerization initiator may also be used. Examples of the reducing agent include formaldehyde alkali metal sulfoxylate such as Rongalite (sodium formaldehyde sulfoxylate); sulfites such as sodium sulfite and sodium hydrogensulfite; pyrosulfites such as sodium pyrosulfite; thiosulfates such as sodium thiosulfate; phosphates such as phosphorous acid and sodium phosphate; pyrophosphites such as sodium pyrophosphite; mercaptans; ascorbates such as ascorbic acid and sodium ascorbate; erythorbates such as erythorbic acid and sodium erythorbate; sugars such as glucose and dextrose; and metal salts such as ferrous sulfate and copper sulfate. Examples of the chelating agent include sodium pyrophosphate and ethylenediaminetetraacetate. The amount of each of these initiators, reducing agents and chelating agents used is decided by the combination in each initiator system.

The composite resin emulsion used in the present invention may include one or more other polymers, provided that resulting properties of the leather-like sheet are not degraded. Examples include synthetic rubbers such as an acrylonitrile-butadiene copolymers, polybutadiene, and polyisoprene; and synthetic polymers having elasticity such as ethylene-propylene copolymers, polyacrylates, acrylic copolymers, silicones, other polyurethanes, polyvinyl acetate, polyvinyl chloride, polyester-polyether block copolymers and ethylene-vinyl acetate The composite resin emulsion may comprise one or more of these polymers.

If necessary, the composite resin emulsion may comprise one or more of known additives such as antioxidants, ultraviolet ray absorbers, surfactants such as a penetrant; thickeners, mildew resistant agents, water-soluble macromolecular compounds such as polyvinyl alcohol or carboxymethylcellulose, dyes, pigments, fillers, and solidification adjusters. The composite resin emulsion may be used not only as a component of a leather-like sheet but also as a film-forming material, paint, a coating agent, a fiber treating agent, an adhesive, a glass fiber converging agent or the like.

The method for impregnating the fibrous substrate with the composite resin emulsion may be any method as long as the method makes it possible to impregnate the fibrous substrate homogeneously with the emulsion. In general, the method of immersing the fibrous substrate into the composite resin emulsion is preferred. The fibrous substrate is impregnated with the emulsion and subsequently a press roll or a doctor blade is used to adjust the amount of the impregnation of the fibrous substrate with the emulsion to an appropriate level.

Next, the composite resin emulsion with which the fibrous substrate is impregnated is solidified by heating. Examples of methods for heating and solidifying the composite resin emulsion include the method (1) of immersing the fibrous substrate impregnated with the emulsion into a hot water bath of 70 to 100° C. to solidify the emulsion, the method (2) of spraying water. vapor heated to 100 to 200° C. on the substrate impregnated with the emulsion to solidify the emulsion, and the method (3) of introducing the substrate impregnated with the emulsion, directly into a drying machine heated to a temperature of 50 to 150° C. and drying it by heating to solidify the emulsion.

Above all, the solidifying method (1) in the hot water bath or the solidifying method (2) using the heated water vapor are preferred, because these methods make it possible to obtain a leather-like sheet having a softer hand feel. The solidification temperature the composite resin emulsion in methods (1)–(3) is preferably a temperature at least 10° C. higher than the thermal gelation temperature of this emulsion, in order to prevent uneven distribution of the composite resin in the fibrous substrate by too rapid solidification of the emulsion. When the solidifying methods (1) or (2) are used, the solidified leather like sheet is dried by heating or air, to remove water contained in the leather-like sheet.

For leather-like sheets obtained by impregnating the fibrous substrate with the composite resin emulsion, solidifying the emulsion and drying the solidified sheet, the amount of polymer incorporated into the leather-like sheet relative to the weight of the fibrous substrate, alone (this includes the total amount of all the polymers of the composite resin emulsion) is preferably from 5 to 150%, more preferably from 10 to 100%, and still more preferably from 20 to 80%. (If the fibrous substrate comprises a microfine fiber-forming fiber, the weight of the fibrous substrate is the weight after being converted into a microfine fiber.) If the amount of the polymer incorporated into the leather-like sheet is less than 5% by weight, the fulfillment feeling of the leather-like sheet is poor so that a hand feel like that of natural leather is not obtained. If the amount of polymer incorporated into the leather-like sheet is more than 150% by weight, the resultant sheet is hard, and a hand feel like that of natural leather is not obtained.

When the fibrous substrate is composed of a microfine fiber-forming fiber, a leather-like sheet is produced by impregnating the fibrous substrate with the composite resin emulsion, solidifying the emulsion, and subsequently converting the microfine fiber-forming fiber into a microfine fiber bundle. If the fibrous substrate is made from the above-mentioned sea-island type composite and/or blend spun fiber, after impregnation with the composite resin emulsion and the solidification thereof, the sea component in the fiber may be dissolved and removed with an organic solvent or the like, causing the island component to remain in a microfine fiber form. Thus,.a leather-like sheet is produced. The step of removing the sea component with an organic solvent may be conducted in accordance with methods or conditions that have been previously adopted in the production of artificial leather or the like. The step of converting the microfine fiber-forming fiber into a microfine fiber bundle after the solidification of the composite resin emulsion has the effect of removing the sea component of the sea-island type fiber, which was restrained by the composite resin. The microfine fiber, which was originally the island component of the microfine fiber forming fiber, and which did not contact the composite resin, remains and is only weakly restrained by the composite resin.

The leather-like sheet of the present invention, obtained by the above-mentioned process, has high softness, fulfillment feeling, and a good hand feel like that of natural leather. This sheet is superior to artificial leather obtained by the conventional wet solidifying method. According to the results of electron microscopy studies by the inventors, the fiber in the fibrous substrate of the leather-like sheets of the present invention is not strongly restrained by the composite resin. It is also observed that, when the fiber is converted into a microfine fiber bundle, the appropriate spaces remain in the bundles of the microfine fiber. Therefore, the leather-like sheets of the present invention do not exhibit a drop in softness caused by the restraint of the fibers and settling of the sheet. Moreover, it is possible to obtain a leather-like sheet having better softness and fulfillment feeling than conventional leather-like sheets, and having excellent hand feel that is very similar to natural leather by increasing the apparent filling of spaces between the fibers with composite resin particles (when the fiber is made into a microfine form, the spaces are between the bundles of the microfine fibers).

The above-mentioned excellent properties of the leather-like sheet of the present invention permits them to be used in a wide range of products such as mattresses, liner materials for bags, core materials for clothing, core materials for shoes, cushioning materials, interior furnishings for cars, trains or airplanes, wall materials and carpets. When the fiber is made into a microfine fiber form, the microfine fiber may be subjected to buffing to obtain an artificial leather sheet like suede. The leather-like sheets of the present invention are also suitable for clothing, as covering material for furniture such as chairs or sofas, as a cover for a train or a car, wallpaper, gloves or the like. If a polyurethane layer is disposed onto a single side of the leather-like sheet of the present invention, the resultant sheet is suitable for use as an artificial leather with a grain-like surface, which may used for sports shoes, mens shoes, bags,. handbags, satchels or the like.

Obviously, numerous modifications and variations on the present invention are possible in light of the above teachings. It is therefore to be understood that within the scope of the appended claims, the invention may be practiced otherwise than as specifically described herein.

The following will specifically describe the present invention by way of examples, without limiting the invention to such examples. In the following Examples and Comparative Examples, the thermal gelation temperature, the elastic modulus of films at 90° C. and 160° C., a dispersion temperature, and softness and hand feel of sheets are measured or estimated by the following methods.

Thermal Gelation Temperature

Ten grams of an emulsion were weighed out and put into a test tube. The test tube was shaken in a hot water bath having a constant temperature of 90° C. to raise the temperature of the test tube. The temperature of the emulsion when it gelled and lost its fluidity was defined as the thermal gelation temperature.

Elastic Moduli at 90° C. and 160° C. and a Dispersion Temperature

A 100 $\mu$m thick film of a composite resin, which was obtained by drying an emulsion at 50° C., was heated at 130° C. for 10 minutes. Thereafter, a viscoelasticity measuring device (FT Rheospectoler "DVE-V4", made by Rheology Company) was used to measure. at a frequency of 11 Hz, the elastic moduli (E') at 90° C. and 160° C., and the a dispersion temperature (T$\alpha$) of the film.

Softness

A leather-like sheet was cut into a 10 cm square piece. At a temperature of 20° C., a pure bending test machine ("KES-FB2-L". made by KATO TEKKO) was used to measure the flexural rigidity ratio (gfcm$^2$/cm) of the piece perpendicular to the direction along which the nonwoven fabric used in the production of the leather-like sheet was wound. The flexural rigidity ratio was used as the index of softness.

Bending Fatigue Resistance

A leather-like sheet was cut into a 7 cm×4.5 cm piece. A bending test at 20° C. was performed according to JIS-K 6545, using a flexibility test device ("Flexometer" made by Bally Company). Every time the sheet piece was bent 100,000 times, the surface state of the sheet piece was observed to measure the number of the bending operations until a crack or a slit was generated. Bending fatigue resistance and endurance were considered sufficiently good when no crack or slit was generated even after the sheet piece was bent 500,000 times Hand Feel Leather-like sheet samples were felt with the hands. If the sheet felt like natural leather, the hand feel was evaluated as "good". If the sheet felt harder than natural leather and had insufficient softness, and/or if the sheet had insufficient fulfillment feeling in that the hand feel did not feel like natural leather, the hand feel was evaluated as "bad".

Abbreviated symbols used in Examples and Comparative Examples are shown in Tables 1 and 2.

TABLE 1

| Abbreviated symbols | Names of compounds |
|---|---|
| PMPA2000 | Polyester diol having a number-average molecular weight of 2000 (produced by reacting 3-methyl-1,5-pentanediol with adipic acid) |
| PTMG1000 | Polytetramethylene glycol having a number-average molecular weight of 1000 |
| PHC2000 | Polyhexamethylene carbonate glycol having a number-average molecular weight of 2000 |
| PCL2000 | Polycaprolactone glycol having a number-average molecular weight of 2000 |

TABLE 1-continued

| Abbreviated symbols | Names of compounds |
|---|---|
| TDI | 2,4-Tolylene diisocyanate |
| MDI | 4,4'-Diphenylmethane diisocyanate |
| DMPA | 2,2-Bis(hydroxymethyl)propionic acid |
| MEK | 2-Butanone |
| TEA | Triethylamine |
| DETA | Diethylenetriamine |
| IPDA | Isophoronediamine |
| EDA | Ethylenediamine |

TABLE 2

| Abbreviated symbols | Names of compounds |
|---|---|
| BA | Butyl acrylate |
| EHA | 2-Ethylhexyl acrylate |
| MMA | Methyl methacrylate |
| St | Styrene |
| HDDA | 1,6-Hexanediol diacrylate |
| ALMA | Allyl methacrylate |
| CHP | Cumene hydroperoxide |

REFERENCE EXAMPLE 1

Production of a Fibrous Substrate 60 parts by weight of nylon-6 and 40 parts by weight of high-fluidity polyethylene were blend-spun, stretched, and cut to obtain a sea-island type blend spun fiber (monofilament fineness: 4 deniers, fiber length: 51 mm, and island component: nylon-6). This fiber was converted to a fiber-entangled nonwoven fabric having an apparent density of 0.160 g/cm$^3$ using a card, a cross lapper, and a needle punch. This nonwoven fabric was heated to melt the polyethylene sea component and thermally fix elements of the fiber to each other, thereby giving a fiber-entangled nonwoven fabric of 0.285 g/cm$^3$ in apparent density, both surfaces of which were made smooth. (This fabric is referred to hereinafter as nonwoven fabric ①.

REFERENCE EXAMPLE 2

Production of a Fibrous Substrate 70 parts by weight of polyethylene terephthalate and 30 parts by weight of low-density polyethylene were used to produce a sea-island type composite spun fiber (monofilament fineness: 4 deniers, fiber length: 51 mm, island component: polyethylene terephthalate, and the number of the islands in a cross section of the fiber: 15). This fiber was converted to a fiber-entangled nonwoven fabric using a card, a cross lapper, and a needle punch. Next, the fabric was immersed into 70° C. hot water to shrink the fabric so that its shrinkage percentage based on area would be 30%. This nonwoven fabric was heated to melt the polyethylene sea component and thermally fix elements of the fiber to each other, thereby giving a fiber-entangled nonwoven fabric of 0.35 g/cm$^3$ in apparent density, both surfaces of which were made smooth. (This fabric is referred to hereinafter as nonwoven fabric ③.

REFERENCE EXAMPLE 3

Production of a Fibrous Substrate 70 parts by weight of polyethylene terephthalate and 30 parts by weight of polystyrene were used to produce a sea-island type composite spun fiber (monofilament fineness: 4 deniers, fiber length: 51 mm, island component: polyethylene terephthalate, and the number of the islands in a cross section of the fiber: 15). A fiber-entangled nonwoven fabric was prepared as in Reference Example 2, and had an apparent density of 0.32 g/cm$^3$. Both surfaces were made smooth. Elements of the fiber were thermally fixed to each other. (This fabric is referred to hereinafter as nonwoven fabric ③.)

REFERENCE EXAMPLE 4

Production of a Fibrous Substrate

A polyethylene terephthalate fiber (monofilament fineness: 2 deniers, fiber length: 51 mm, and shrinkage percentage in 70° C. hot water: 25%) was used to produce a web having a weight of 240 g/m$^2$ using a card and a cross lapper. This web was passed through a needle locker room and subjected to needle punch treatment at 700 needles/cm$^2$. Thereafter, the web was immersed in 70° C. hot water for 2 minutes to shrink the web to 56% of the original area. The web was then pressed at 155° C. with a cylinder belt press machine to produce a nonwoven fabric having a thickness of 1.2 mm, a weight of 360 g/cm$^2$, and an apparent density of 0.30 g/cm$^3$. This nonwoven fabric was impregnated with an emulsion (solid concentration: 5% by weight) of a silicone-based, softening, water-repellent compound comprising a mixture of dimethylpolysiloxane ("KF96L" made by Shin-Etsu Chemical Co., Ltd. and methylhydrogenpolysiloxane ("KF99 " made by Shin-Etsu Chemical Co., Ltd.). at a weight ratio of 1/1. The nonwoven fabric was squeezed with a roll, and then dried at 130° C. for 30 minutes to give a nonwoven fabric to which the silicone-based softening water-repellent adhered in an amount of 1.2% by weight relative to the weight of the nonwoven fabric. (This fabric is referred to hereinafter as nonwoven fabric ④.)

REFERENCE EXAMPLE 5

Production of a Fibrous Substrate

A common polyethylene terephthalate fiber (monofilament fineness: 2.5 deniers) and a nylon fiber (monofilament fineness: 1.5 deniers) were used at a weight ratio of 35/65 to produce a fiber-entangled nonwoven fabric (thickness: 1.4 mm, and apparent density 0.25 g/cm$^3$). This fabric was impregnated with a 5 weight % aqueous solution of a silicone-based, softening, water-repellent compound ("Gelanex SH" made by Matsumoto Yushi-Seiyaku Co., Ltd.). The nonwoven fabric was squeezed with a roll, and then dried at 130° C. for 30 minutes to give a nonwoven fabric to which the silicone-based, softening, water-repellent compound adhered in an amount of 1.0% by weight relative to the weight of the nonwoven fabric. (This fabric is referred to hereinafter as nonwoven fabric ⑤.)

REFERENCE EXAMPLE 6

Production of a Polyurethane-Based Emulsion

Into a three-neck flask were added 300.0 g of PMPA2000, 60.87 g of TDI, and 7.85 g of DMPA, and the mixture was stirred in an atmosphere of dry nitrogen at 90° C. for 2 hours to quantitatively react the hydroxyl groups in the mixture, and thereby forming an isocyanate terminated prepolymer. To this prepolymer was added 195.4 g of MEK, and the mixture was homogeneously mixed. Thereafter, the temperature inside the flask was lowered to 40° C. and then 5.92 g of TEA was added followed by stirring for 10 minutes. Next, an aqueous emulsifier solution of 7.83 g of sodium lauryl sulfate dissolved in 285.0 g of distilled water was added to the above-mentioned prepolymer, and then the mixture was emulsified by stirring with a homomixer for 1 minute. Immediately after emulsification in the homomixer, an aqueous solution of 6.91 g of DETA and 5.70 g of IPDA dissolved in 496.4 g of distilled water was added, and the resulting mixture was stirred with the homomixer for 1 minute to perform a chain-extending reaction. Subsequently, MEK was removed with a rotary evaporator to give a polyurethane emulsion (referred to as PU ①) having a solid content of 35% by weight.

REFERENCE EXAMPLE 7

Production of a Polyurethane-Based Emulsion

Into a three-neck flask were added 200.0 g of PHC2000, 100.0 g of PTMG1000, 105.1 g of MDI and 8.85 g of DMPA, and the mixture was stirred in an atmosphere of dry nitrogen at 90° C. for 2 hours to quantitatively react the hydroxyl groups in the mixture, thereby forming an isocyanate terminated prepolymer. To this prepolymer was added 219.1 g of MEK, and the mixture was homogeneously mixed. Thereafter, the temperature inside the flask was lowered to 40° C., and then 6.68 g of TEA was added, followed by stirring for 10 minutes. Next, an aqueous emulsifier solution of 13.17 g of sodium polyoxyethylenetridecylether acetate (anionic emulsifier "ECT-3NEX", made by Japan Surfactant Company) dissolved in 319.9 g of distilled water, was added to the above-mentioned prepolymer, and then the mixture was emulsified by stirring with a homomixer for 1 minute. Immediately thereafter, an aqueous solution of 4.52 g of DETA and 11.20 g of IPDA dissolved in 538.0 g of distilled water was added, and then the mixture was stirred with the homomixer for 1 minute to perform a chain-extending reaction. Subsequently, MEK was removed with a rotary evaporator to give a polyurethane emulsion (referred to as PU ②) having a solid content of 35% by weight.

REFERENCE EXAMPLE 8

Production of a Polyurethane-Based Emulsion

Into a three-neck flask were added 300.0 g of PCL2000, 70.53 g of TDI, and 10.06 g of DMPA, and the mixture was stirred in an atmosphere of dry nitrogen at 90° C. for 2 hours to quantitatively react the hydroxyl groups in the mixture, thereby forming an isocyanate terminated prepolymer. To this prepolymer was added 204.4 g of MEK, and the mixture was homogeneously mixed. Thereafter, the temperature inside the flask was lowered to 40° C., and then 7.59 g of TEA was added followed by stirring for 10 minutes. Next, an aqueous emulsifier solution of 12.29 g of sodium lauryl sulfate dissolved in 296.3 g of distilled water, was added to the above-mentioned prepolymer, and then the mixture was emulsified by stirring with a homomixer for 1 minute. Immediately thereafter, an aqueous solution of 8.82 g of DETA and 2.57 g of EDA dissolved in 521.2 g of distilled water was added, and then the mixture was stirred with the homomixer for 1 minute to perform a chain-extending reaction. Subsequently, MEK was removed with a rotary evaporator to give a polyurethane emulsion (referred to as PU ③) having a solid content of 35% by weight.

REFERENCE EXAMPLE 9

Production of a Polyurethane-Based Emulsion

Into a three-neck flask were added 200.0 g of PHC2000, 100.0 g of PTMG1000, 80.91 g of IPDI and 7.38 g of DMPA, and the mixture was stirred in an atmosphere of dry nitrogen at 90° C. for 2 hours to quantitatively react the hydroxyl groups in the mixture, thereby forming an isocyanate terminated prepolymer. To this prepolymer was added 203.1 g of MEK, and the mixture was homogeneously mixed. Thereafter, the temperature inside the flask was lowered to 40° C., and then 5.57 g of TEA was added followed by stirring for 10 minutes. Next, an aqueous emulsifier solution of 12.21 g of sodium lauryl sulfate dissolved in 298.5 g of distilled water, was added to the above-mentioned prepolymer, and then the mixture was emulsified by stirring with a homomixer for 1 minute. Immediately thereafter, an aqueous solution of 1.78 g of DETA and 13.23 g of IPDA dissolved in 514.1 g of distilled water was added, and then the mixture was stirred with the homomixer for 1 minute to a perform chain-extending reaction. Subsequently, MEK was removed with a rotary evaporator to give a polyurethane emulsion (referred to as PU ④) having a solid content of 35% by weight.

EXAMPLE 1

Production of a Composite Resin Emulsion and a Leather-Like Sheet

Into a flask equipped with a cooling tube were added 240 g of PU ①, 0.020 g of ferrous sulfate heptahydrate ($FeSO_4 \cdot 7H_2O$), 0.294 g of potassium pyrophosphate, 0.451 g of Rongalite (bihydrate salt of sodium formaldehyde sulfoxylate), 0.020 g of disodium ethylenediamine tetraacetate (EDTA. 2Na) and 246 g of distilled water. The temperature of the mixture was raised to 40° C., and then interior of the flask was flushed with nitrogen. Next, a mixture (monomer ①) of 152.1 g of BA, 3.14 g of HDDA, 1.57 g of ALMA and 1.57 g of ECT-3NEX, and an emulsion (initiator ①) of 0.314 g of CHP, 0.314 g of ECT-3NEX and 15.0 g of distilled water were added dropwise into the flask over 4 hours through different dropping funnels. After this addition, the flask was kept at 40° C. for 30 minutes. Thereafter, a mixture (monomer ②) of 38.4 g of MMA, 0.78 g of HDDA, 0.392 g of ECT-3NEX, and an emulsion (initiator ②) of 0.078 g of CHP, 0.078 g of ECT-3NEX and 3.0 g of distilled water into the flask were added dropwise over 1.5 hour through different dropping funnels. After the addition, the flask was kept at 50° C. for 60 minutes to complete the polymerization. Thus, an emulsion having a solid content of 40% by weight was obtained. Four parts by weight of a nonionic surfactant ("Emulgen 109P", made by Kao Corp.) and 1 part of calcium chloride were blended with 100 parts by weight of the above-mentioned emulsion to give a thermally gellable emulsion. The thermal gelation temperature of this emulsion, and elastic moduli at 90° C. and 160° C., and Tα of a film obtained by drying the emulsion are as shown in Table 4.

The nonwoven fabric ① of Reference Example 1 was immersed into a bath of the above-mentioned thermally gellable emulsion, to impregnate the nonwoven fabric ① with the emulsion. The nonwoven fabric ① was then taken out from the bath, squeezed with a press roll, and then immersed into a 90° C. hot water bath for 1 minute to solidify the thermally gellable emulsion. The nonwoven fabric ① was dried in a hot air drier at 130° C. for 30 minutes to produce a sheet. Next, this sheet was immersed into toluene at 90° C. and during the immersion a squeezing treatment with a press roll was performed at 2 kg/cm$^2$, 5 times, to dissolve and remove the sea component (polyethylene) of the sea-island type blend spun fiber of the nonwoven fabric, thereby giving a leather-like sheet in which the composite resin penetrated into the entangled nylon-6 nonwoven fabric and was solidified. The amount of the composite resin incorporated into this leather-like sheet was 57% by weight relative to the weight of the nonwoven fabric after it was converted into a microfine fiber form. This sheet, like natural leather, had good softness and fulfillment feeling and excellent hand feel and endurance, as shown in Table 4.

EXAMPLE 2

Using the method of Example 1, the raw materials shown in Table 3 were used to prepare a thermally gellable emulsion. The thermal gelation temperature of this emulsion, and elastic moduli at 90° C. and 160° C., and Tα of a film obtained by drying this emulsion are as shown in Table 4. Using the method of Example 1, the nonwoven fabric ② of Reference Example 2 was impregnated with the above-mentioned thermally gellable emulsion to produce a sheet. Next, the sheet was immersed into toluene at 90° C. and during the immersion a squeezing treatment with a press roll was performed at 2 kg/cm$^2$, 5 times, to dissolve and remove the sea component (polyethylene) of the sea-island type composite spun fiber which made up the nonwoven fabric, thereby giving a leather-like sheet in which the composite resin penetrated into the entangled nonwoven fabric of polyethyleneterephthalate, and was solidified. The amount of the composite resin incorporated into this leather-like sheet was 52% by weight relative to the weight of the nonwoven fabric after having been converted into a microfine fiber form. This sheet, like natural leather, had a good softness and fulfillment feeling and was excellent in hand feel and endurance, as shown in Table 4.

EXAMPLE 3

Using the method of Example 1, the raw materials shown in Table 3 were used to prepare a thermally gellable emulsion. The thermal gelation temperature of this emulsion, and elastic moduli at 90° C. and 160° C., and Tα of a film obtained by drying the emulsion are as shown in Table 4. The nonwoven fabric ③ of Reference Example 3 was immersed into a bath of the thermally gellable emulsion to impregnate the nonwoven fabric ③ with this emulsion. The nonwoven fabric ③ was removed from the bath, and squeezed with a press roll. Steam having a pressure of 1.5 kg/cm$^2$ was then sprayed on the whole nonwoven fabric ③ to solidify the thermally gellable emulsion, and was then dried in a hot air dryer at 130° C. for 30 minutes to produce a sheet. Next, the sheet was immersed into toluene at 90° C. and during the immersion a squeezing treatment with a press roll was performed at 2 kg/cm$^2$, 5 times, to dissolve and remove the sea component (polystyrene) of the sea-island type composite spun fiber which made up the nonwoven fabric, thereby giving a leather-like sheet in which the composite resin penetrated into the entangled nonwoven fabric of polyethyleneterephthalate and was solidified. The amount of the composite resin incorporated into this leather-like sheet was 61% by weight relative to the weight of the nonwoven fabric after having been converted into a microfine fiber form. This sheet. like natural leather, had a good softness and fulfillment feeling and had excellent hand feel and endurance, as shown in Table 4.

EXAMPLE 4

Using the method of Example 1, the raw materials shown in Table 3 were used to prepare a thermally gellable emulsion. The thermal gelation temperature of this emulsion, and elastic moduli at 90° C. and 160° C., and Tα of a film obtained by drying this emulsion are as shown in Table 4. To 100 parts of the above-mentioned thermally gellable emulsion was added 0.5 part of a substrate-moistening agent ("Polyflow-KL-260", made by TCS Company) as a penetrant, and then the nonwoven fabric ① of Reference Example 1 was immersed into a bath of this thermally gellable emulsion in order to impregnate the nonwoven fabric ① with this emulsion. The nonwoven fabric ① was removed from the bath, squeezed with a press roll and then heated in a hot air drier at 130° C. for 30 minutes to solidify the emulsion and dry the nonwoven fabric ①. Thus, a sheet was obtained. Next, the method of Example 1 was performed to dissolve and remove the sea component (polyethylene) of the sea-island type blend spun fiber which made the nonwoven fabric, thereby giving a leather-like sheet wherein the composite resin penetrated into the entangled nonwoven nylon-6 fabric and was solidified. The amount of the composite resin incorporated into this leather-like sheet was 59% by weight relative to the weight of the nonwoven fabric after having been converted into a microfine fiber form. This sheet, like natural leather, had a good softness and fulfillment feeling and had excellent hand feel and endurance, as shown in Table 4.

TABLE 3

| | Example | | | | Comparative Example | | |
|---|---|---|---|---|---|---|---|
| | 1 | 2 | 3 | 4 | 1 | 2 | 3 |
| Initial charging | | | | | | | |
| PU emulsion | PU ① 240 g | PU ① 400 g | PU ② 560 g | PU ③ 240 g | PU ③ 240 g | PU ① 240 g | PU ① 240 g |
| $FeSO_4$ $7H_2O$ | 0.020 g | 0.014 g | 0.008 g | 0.020 g | 0.020 g | 0.020 g | 0.020 g |
| Potassium pyrophosphate | 0.294 g | 0.210 g | 0.126 g | 0.294 g | 0.294 g | 0.294 g | 0.294 g |
| Rongalite | 0.451 g | 0.322 g | 0.193 g | 0.451 g | 0.451 g | 0.451 g | 0.451 g |
| EDTA.2Na | 0.020 g | 0.014 g | 0.008 g | 0.020 g | 0.020 g | 0.020 g | 0.020 g |
| Distilled water | 246 g | 143 g | 43 g | 252 g | 244 g | 244 g | 246 g |
| Monomer ① | | | | | | | |
| BA | 152.1 g | 119.7 g | 40.3 g | 163.9 g | | 192.1 g | 152.1 g |
| EHA | | | 7.56 g | 18.6 g | | | |
| MMA | | | | | 186.2 g | | |
| HDDA | 3.14 g | 6.30 g | 2.52 g | 1.86 g | 9.80 g | 3.92 g | 3.14 g |
| ALMA | 1.57 g | | | 1.86 g | | | 1.57 g |
| ECT-3NEX*1) | 1.57 g | 1.26 g | 0.504 g | 1.86 g | 1.96 g | 1.96 g | 1.57 g |
| Initiator ① | | | | | | | |
| CHP | 0.314 g | 0.252 g | 0.101 g | 0.186 g | 0.392 g | 0.392 g | 0.314 g |
| ECT-3NEX*1) | 0.314 g | 0.252 g | 0.101 g | 0.186 g | 0.392 g | 0.392 g | 0.314 g |
| Distilled water | 15.0 g | 15.0 g | 10.0 g | 10.0 g | 20.0 g | 20.0 g | 15.0 g |
| Monomer ② | | | | | | | |
| MMA | 38.4 g | 11.2 g | 30.2 g | 9.80 g | — | — | 38.4 g |
| BA | | | 3.36 g | | | | |
| St | | 2.8 g | | | — | — | |
| HDDA | 0.78 g | | | | — | — | 0.78 g |
| ECT-3NEX*1) | 0.392 g | 0.140 g | 0.336 g | 0.098 g | — | — | 0.392 g |
| Initiator ② | | | | | | | |
| CHP | 0.078 g | 0.028 g | 0.067 g | 0.018 g | — | — | 0.078 g |
| ECT-3NEX*1) | 0.078 g | 0.028 g | 0.067 g | 0.018 g | — | — | 0.078 g |
| Distilled water | 3.0 g | 2.0 g | 3.0 g | 2.0 g | — | — | 3.0 g |
| Gelatinizing agent | | | | | | | |
| Emulgen 109P | 4 parts | 4 parts | 4 parts | 4 parts | 4 parts | 4 parts | — |
| $CaCl_2$ | 1 part | 1 part | 1 part | 1 part | 1 part | 1 part | |
| Solid content (% by weight) | 40 | 40 | 40 | 40 | 40 | 40 | 40 |

COMPARATIVE EXAMPLE 1

Using the method of Example 1, only MMA was used as a monofunctional ethylenically unsaturated monomer, as shown in Table 3, to obtain a thermally gellable emulsion. The thermal gelation temperature of this emulsion, and elastic moduli at 90° C. and 160° C., and Tα of a film obtained by drying the emulsion, are as shown in Table 4. Using the method of Example 1, the nonwoven fabric ① of Reference Example 1 was impregnated with the above-mentioned thermally gellable emulsion. Thereafter, the sea component (polyethylene) of the sea-island type blend spun fiber which made up the nonwoven fabric was dissolved and removed to give a leather like sheet in which the composite resin penetrated into the entangled nonwoven nylon-6 fabric and was solidified. The amount of the composite resin incorporated into this leather-like sheet was 58% by weight relative to the weight of the nonwoven fabric after having been converted into a microfine fiber form. The elastic modulus of this sheet at 90° C. was higher than the range defined by the present invention. Thus, this sheet had poor softness and was hard. The amount of the resin incorporated into the sheet, bending fatigue resistance, flexural rigidity and hand feel are shown in Table 4.

COMPARATIVE EXAMPLE 2

Using the method of Example 1, only BA was used as a monofunctional ethylenically unsaturated monomer, as shown in Table 3, to obtain a thermally gellable emulsion. The thermal gelation temperature of this emulsion, and elastic moduli at 90° C. and 160° C. and Tα of a film obtained by drying this emulsion are as shown in Table 4. Using the method of Example 1, the nonwoven fabric ① of Reference Example 1 was impregnated with the above-mentioned thermally gellable emulsion. Thereafter, the sea component (polyethylene) of the sea-island type blend spun fiber which made the nonwoven fabric was dissolved and removed to give a leather-like sheet in which the composite resin penetrated into the entangled nonwoven nylon-6 fabric and was solidified. The amount of the composite resin incorporated into this leather-like sheet was 57% by weight relative to the weight of the nonwoven fabric after having been converted into a microfine fiber form. The elastic modulus of this sheet at 160° C. was lower than the range defined by the present invention. Thus, this sheet experienced settling and consequently resembled paper and was not completely dense. The amount of the resin incorporated into the sheet, bending fatigue resistance, flexural rigidity and hand feel are shown in Table 4.

TABLE 4

| | Example | | | | Comparative Example | | |
|---|---|---|---|---|---|---|---|
| | 1 | 2 | 3 | 4 | 1 | 2 | 3 |
| Thermal gelation temperature (° C) | 52 | 54 | 49 | 51 | 50 | 54 | >90 |
| E'(90° C.)*1) | $1.3 \times 10^8$ | $4.8 \times 10^7$ | $1.4 \times 10^8$ | $2.5 \times 10^7$ | $7.2 \times 10^8$ | $8.8 \times 10^6$ | $1.3 \times 10^8$ |
| E'(160° C.)*1) | $3.7 \times 10^7$ | $2.9 \times 10^7$ | $3.9 \times 10^7$ | $1.6 \times 10^7$ | $4.1 \times 10^7$ | $3.8 \times 10^6$ | $3.7 \times 10^7$ |
| T α (° C.) | −33 | −37 | −31 | −38 | 5 | −38 | −33 |
| Nonwoven fabric | Nonwoven fabric ① | Nonwoven fabric ② | Nonwoven fabric ③ | Nonwoven fabric ① | Nonwoven fabric ① | Nonwoven fabric ① | Nonwoven fabric ① |
| Amount of resin incorporated into the sheet/fiber weight (% by weight) | 57 | 52 | 61 | 59 | 58 | 57 | 34 |
| Bending fatigue resistance (10000 times) | Good | Good | Good | Good | 20 | Good | Good |
| Flexural rigidity*2) | 5.0 | 5.1 | 5.5 | 3.8 | 11.2 | 9.7 | 8.9 |
| Hand feel | Good | Good | Good | Good | Bad | Bad | Bad |

*1)Unit: dyn/cm$^2$
*2)Unit: gfcm$^2$/cm

COMPARATIVE EXAMPLE 3

The method of Example 1 was performed except that Emulgen 109P and calcium chloride were not blended into the emulsion. This emulsion was not thermally gellable. The elastic moduli at 90° C. and 160° C., and Tα of a film obtained by drying the emulsion are as shown in Table 4. Using the method of Reference Example 1, the nonwoven fabric ① of Reference Example 1 was impregnated with the above-mentioned emulsion. However, because this emulsion was not thermally gellable, it flowed out into the hot water bath and the bath was polluted. Next, using the method of Example 1, the sea component (polyethylene) of the sea-island type blend spun fiber which made up the nonwoven fabric was dissolved and removed to give a leather-like sheet wherein the composite resin penetrated into the entangled nonwoven nylon-6 fabric and was solidified. The amount of the composite resin incorporated into this leather-like sheet was 34% by weight relative to the weight of the nonwoven fabric after having been converted into a microfine fiber form. Thus, this sheet experienced settling and consequently the sheet resembled paper and was not completely dense. The amount of the resin incorporated into the sheet, bending fatigue resistance, flexural rigidity and hand feel are shown in Table 4.

EXAMPLE 5

The nonwoven fabric ④ of Reference Example 4 was immersed into a bath of the thermally gellable emulsion prepared in Example 1, to impregnate the nonwoven fabric ① with this emulsion. The nonwoven fabric ④ was then taken out from the bath, squeezed with a press roll, and then immersed into a hot water bath at 90° C. for 1 minute to solidify the thermally gellable emulsion. The nonwoven fabric ④ was then dried in a hot air drier at 130° C. for 30 minutes to produce a sheet. This sheet, like natural leather, had a good softness and fulfillment feeling and had excellent hand feel and endurance, as shown in Table 6.

EXAMPLE 6

Into a flask with a cooling tube were added 480 g of PU ①, 0.011 g of ferrous sulfate heptahydrate ($FeSO_4 \cdot 7H_2O$), 0.168 g of potassium pyrophosphate, 0.258 g of Rongalite, 0.011 g of EDTA.2Na and 98 g of distilled water. The temperature of the mixture was raised to 40° C., and then the inside of the flask was purged with nitrogen. Next, a mixture (monomer ①) of 95.2 g of BA, 11.2 g of MMA, 5.60 g of HDDA and 1.12 g of ECT-3NEX, and an emulsion (initiator ① of 0.168 g of CHP, 0.168 g of ECT-3NEX and 10.0 g of distilled water were added dropwise into the flask over 4 hours through different dropping funnels. After the addition, the flask was kept at 50° C. for 60 minutes to complete the polymerization. Thus, an emulsion having a solid content of 40% by weight was obtained. Four parts by weight of "Emulgen 109P" and 1 part of calcium chloride were blended with 100 parts by weight of the above-mentioned emulsion to give a thermally gellable emulsion. The thermal gelation temperature of this emulsion, and elastic modulus at 90° C., and Tα of a film obtained by drying this emulsion are as shown in Table 6.

Using the method of Example 5, the nonwoven fabric ④ of Reference Example 4 was impregnated with the above-mentioned thermally gellable emulsion, to produce a sheet. This sheet, like natural leather, had a good softness and fulfillment feeling and an excellent hand feel and endurance, as shown in Table 4.

EXAMPLE 7

Using the method of Example 1, the raw materials shown in Table 5 were used to prepare a thermally gellable emulsion. The thermal gelation temperature of this emulsion, and elastic modulus at 90° C., and Tα of a film obtained by drying this emulsion are as shown in Table 6. The nonwoven fabric ⑤ of Reference Example 5 was immersed into the bath of the above-mentioned thermally gellable emulsion to impregnate the nonwoven fabric ⑤ with this emulsion. The nonwoven fabric ⑤ was taken out from the bath, and squeezed with a press roll. Steam having a pressure of 1.5 kg/cm$^2$ was then sprayed on the entire nonwoven fabric ⑤ to solidify the thermally gellable emulsion, which was then dried in a hot air dryer at 130° C. for 30 minutes to produce a sheet. This sheet, like natural leather, had a good softness and fulfillment feeling and an excellent hand feel and endurance, as shown in Table 6.

EXAMPLE 8

Using the method of Example 1, the raw materials shown in Table 5 were used to prepare a thermally gellable emulsion. The thermal gelation temperature of this emulsion, and elastic modulus at 90° C., and Tα of a film obtained by drying this emulsion are as shown in Table 6. A commercially available polyester woven/knitted fabric (thickness: 0.85 mm, and apparent density: 0.35 g/cm$^3$) which was not treated with a softening, water-repellent compound was immersed into the bath of the above-mentioned thermally gellable emulsion to impregnate the fabric with this emulsion. The fabric was taken out from the bath, and squeezed with a press roll. Next, the fabric was heated in a hot air dryer at 130° C. for 30 minutes to solidify and dry the emulsion, thereby producing a sheet. This sheet, like natural leather, had a good softness and fulfillment feeling and an excellent hand feel and endurance, as shown in Table 6.

COMPARATIVE EXAMPLE 4

Using the method of Example 6, only MMA was used as a monofunctional ethylenically unsaturated monomer, as shown in Table 5, to obtain a thermally gellable emulsion. The thermal gelation temperature of this emulsion, and elastic modulus at 90° C. and Tα of a film obtained by drying this emulsion are as shown in Table 6. Using the method of Example 1, the nonwoven fabric ④ of Reference Example 4 was impregnated with the above-mentioned thermally gellable emulsion to produce a sheet. The elastic modulus of this sheet at 90° C. was higher than the range defined in by present invention. Thus, this sheet had poor softness and was hard.

COMPARATIVE EXAMPLE 5

Using the method of Example 6, only BA was used as a monofunctional ethylenically unsaturated monomer, as shown in Table 5, to prepare a thermally gellable emulsion. The thermal gelation temperature of this emulsion, and elastic modulus at 90° C., and Tα of a film obtained by drying this emulsion are as shown in Table 6. Using the method of Example 1, the nonwoven fabric ④ of Reference Example 4 was impregnated with the above-mentioned thermally gellable emulsion to produce a sheet. The elastic modulus of this sheet at 90° C. was lower, than the range defined in by present invention. Thus, this sheet had good softness but poor fulfillment feeling.

COMPARATIVE EXAMPLE 6

The method of Example 1 was used except that "Emulgen 109P" and calcium chloride were not blended into the emulsion. This emulsion was not thermally gellable. The elastic modulus at 90° C., and Tα of a film obtained by drying this emulsion are as shown in Table 6.

Using the method of Example 5, the nonwoven fabric ④ of Reference Example 4 was impregnated with the above-mentioned emulsion. The emulsion flowed out into the hot water bath and the bath was polluted. This sheet had localized hard portions, and portions that were not dense and was like a nonwoven fabric.

TABLE 5

| | Example | | | | Comparative Example | | |
|---|---|---|---|---|---|---|---|
| | 5 | 6 | 7 | 8 | 4 | 5 | 6 |
| Initial charging | | | | | | | |
| PU emulsion- | PU ① 240 g | PU ① 480 g | PU ④ 480 g | PU ③ 240 g | PU ① 240 g | PU ④ 240 g | PU ① 240 g |
| $FeSO_4$ $7H_2O$ | 0.020 g | 0.011 g | 0.011 g | 0.020 g | 0.020 g | 0.020 g | 0.020 g |
| Potassium pyrophosphate | 0.294 g | 0.168 g | 0.168 g | 0.294 g | 0.294 g | 0.294 g | 0.294 g |
| Rongalite | 0.451 g | 0.258 g | 0.258 g | 0.451 g | 0.451 g | 0.451 g | 0.451 g |
| EDTA.2Na | 0.020 g | 0.011 g | 0.011 g | 0.020 g | 0.020 g | 0.020 g | 0.020 g |
| Distilled water | 246 g | 98 g | 95 g | 252 g | 244 g | 244 g | 246 g |
| Monomer ① | | | | | | | |
| BA | 152.1 g | 95.2 g | 74.5 g | 163.9 g | | 186.2 g | 152.1 g |
| EHA | | | | 18.6 g | | | |
| MMA | | 11.2 g | | | 186.2 g | | |
| HDDA | 3.14 g | 5.60 g | 2.35 g | 1.86 g | 9.80 g | 9.80 g | 3.14 g |
| ALMA | 1.57 g | | 1.57 g | 1.86 g | | | 1.57 g |
| ECT-3NEX*1) | 1.57 g | 1.12 g | 0.784 g | 1.86 g | 1.96 g | 1.96 g | 1.57 g |
| Initiator ① | | | | | | | |
| CHP | 0.314 g | 0.168 g | 0.157 g | 0.186 g | 0.392 g | 0.392 g | 0.314 g |
| ECT-3NEX*1) | 0.314 g | 0.168 g | 0.157 g | 0.186 g | 0.392 g | 0.392 g | 0.314 g |
| Distilled water | 15.0 g | 10.0 g | 10.0 g | 10.0 g | 20.0 g | 20.0 g | 15.0 g |

TABLE 5-continued

| | Example | | | | Comparative Example | | |
|---|---|---|---|---|---|---|---|
| | 5 | 6 | 7 | 8 | 4 | 5 | 6 |
| Monomer ② | | | | | | | |
| MMA | 38.4 g | — | 26.2 g | 9.80 g | — | — | 38.4 g |
| St | | — | 6.7 g | | — | — | |
| HDDA | 0.78 g | — | 0.67 g | | — | — | 0.78 g |
| ECT-3NEX*1) | 0.392 g | — | 0.336 g | 0.098 g | — | — | 0.392 g |
| Initiator ② | | | | | | | |
| CHP | 0.078 g | — | 0.067 g | 0.018 g | — | — | 0.078 g |
| ECT-3NEX*1) | 0.078 g | — | 0.067 g | 0.018 g | — | — | 0.078 g |
| Distilled water | 3.0 g | — | 3.0 g | 2.0 g | — | — | 3.0 g |
| Gelatinizing agent | | | | | | | |
| Emulgen 109P | 4 parts | 4 parts | 4 parts | 4 parts | 4 parts | 4 parts | — |
| $CaCl_2$ | 1 part | 1 part | 1 part | 1 part | 1 part | 1 part | — |
| Solid content (% by weight) | 40 | 40 | 40 | 40 | 40 | 40 | 40 |

*1): Anionic emulsifier

TABLE 6

| | Example | | | | Comparative Example | | |
|---|---|---|---|---|---|---|---|
| | 5 | 6 | 7 | 8 | 4 | 5 | 6 |
| Thermal gelation temperature (° C.) | 52 | 51 | 49 | 51 | 50 | 54 | >90 |
| E'(90° C.)*1) | $1.3 \times 10^8$ | $1.9 \times 10^7$ | $9.4 \times 10^7$ | $2.5 \times 10^7$ | $7.2 \times 10^8$ | $6.0 \times 10^6$ | $1.3 \times 10^8$ |
| T α (° C.) | −33 | −32 | −30 | −38 | 5 | −33 | −33 |
| Amount of resin incorporated into sheet/fiber weight (% by weight) | 66 | 64 | 30 | 37 | 67 | 65 | 31 |
| Bending fatigue resistance (10000 times) | Good | Good | Good | Good | 10 | Good | Good |
| Flexural rigidity*2) | 5.1 | 4.0 | 5.5 | 4.8 | 11.8 | 2.9 | 7.1 |
| Hand feel | Good | Good | Good | Good | Bad | Bad | Bad |

*1) Unit: $dyn/cm^2$
*2) Unit: $gfcm^2/cm$

REFERENCE EXAMPLE 10

Production of an Acrylic Polymer Emulsion

Into a flask with a cooling tube were added 0.420 g of sodium di(2-ethylhexyl) sulfosuccinate and 520 g of distilled water. The temperature of the mixture was raised to 80° C., and then the inside of the flask was purged with nitrogen. Next, 0.378 g of potassium persulfate was added thereto. After 5 minutes, a mixture of 239.4 g of BA, 7.56 g of HDDA and 5.04 g of ALMA and 1.01 g of sodium di(2-ethylhexyl)sulfosuccinate was added dropwise into the flask over 3 hours through a dropping funnel. After the addition, the flask was maintained at 80° C. for 1 hour. Thereafter, 0. 028 g of potassium persulfate was added. Then, 26.6 g of MMA, 0.840 g of methacrylic acid, 0.560 g of HDDA and 0.1 12 g of sodium di(2-ethylhexyl) sulfosuccinate was added over 1 hour through the dropping funnel. After the addition, the flask was maintained at 80° C. for 1 hour to complete the polymerization. Thus. an emulsion having a solid content of 35% by weight was obtained. (The emulsion is referred to hereinafter as acrylic emulsion ①.)

COMPARATIVE EXAMPLE 7

Acrylic/PU Blend Type

Into a mixture of 50 parts by weight of PU ① of Reference Example 6 and the acrylic emulsion ① of Reference Example 10 were added 4 parts by weight of a nonionic surfactant ("Emulgen 109P" made by Kao Corp.) and 1 part by weight of calcium chloride, to obtain a thermally gellable emulsion. The thermal gelation temperature of this emulsion, and elastic moduli at 90° C. and 160° C. and Tα of a film obtained by drying this emulsion were 50° C., $5.9 \times 10^7$ $dyn/cm^2$, $1.3 \times 10^7$ $dyn/cm^2$, and −41 ° C., respectively.

Using the method of Example 1, the nonwoven fabric ① of Reference Example 1 was impregnated with the above-mentioned thermally gellable emulsion. Thereafter, the sea component (polyethylene) of the sea-island type blend spun fiber which made up the nonwoven fabric was dissolved and removed to give a leather-like sheet in which the mixture of the polyurethane and the acrylic polymer penetrated into the microfine fiber bundle entangled nonwoven nylon-6 fabric and was solidified. The amount of the mixture of the polyurethane and the acrylic polymer which was incorporated into this leather-like sheet was 45% by weight relative to the weight of the nonwoven fabric after having been converted into a microfine fiber form. Thus, this sheet experienced settling and consequently the sheet resembled paper and was not completely dense. Its bending fatigue resistance, flexural rigidity and hand feel were good, 9.9 $gfcm^2/cm$, and bad, respectively.

COMPARATIVE EXAMPLE 8

Acrylic Type Alone

Into 100 parts by weight of the acrylic emulsion ① of Reference Example 10 were added 4 parts by weight of a nonionic surfactant ("Emulgen 109P" made by Kao Corp.) and 1 part by weight of calcium chloride, to obtain a thermally gellable emulsion. The thermal gelation temperature of this emulsion, and elastic modulus at 90° C. and Tα of a film obtained by drying this emulsion were 48° C., $3.4\times10^7$ dyn/cm$^2$ and −43° C., respectively. The elastic modulus at 160° C. could not be measured because the film was torn.

Using the method of Example 1, the nonwoven fabric ① of Reference Example 1 was impregnated with the above-mentioned thermally gellable emulsion. Thereafter, the sea component (polyethylene) of the sea-island type blend spun fiber which made up the nonwoven fabric was dissolved and removed to give a leather-like sheet in which the acrylic polymer penetrated into the microfine fiber bundle entangled nonwoven nylon-6 fabric and was solidified. As a result, when the fiber was converted into a microfine fiber bundle, the acrylic polymer was eluted out with polyethylene. The amount of the acrylic polymer incorporated into this leather-like sheet was 18% by weight relative to the weight of the nonwoven fabric after having been converted into a microfine fiber form. This sheet had poor softness and was hard. Its bending fatigue resistance, flexural rigidity and hand feel were 300,000, 11.8 gfcm$^2$/cm, and bad, respectively.

According to the process of the present invention, it is possible to produce, at a low price, a leather-like sheet having a hand feel like that of natural leather and having an improved softness and fulfillment feeling compared to sheets made from conventional emulsion type resins. In particular, if the fibrous substrate comprises a microfine fiber, and the composite resin emulsion of the present invention is used, it is possible to produce a leather-like sheet which has better softness and fulfillment feeling and a hand feel like that of natural leather.

The priority documents of the present application, Japanese patent application 87839/1999 filed Mar. 30, 1999, Japanese patent application 87840/1999 filed Mar. 30 1999, Japanese patent application 111576/1999 filed Apr. 20, 1999, and Japanese patent application 111577/1999 filed Apr. 20, 1999 are incorporated herein by reference.

What is claimed is:

1. A leather-like sheet obtained by the process comprising:

impregnating a fibrous substrate with a thermally gellable composite resin emulsion obtained by emulsion polymerizing an ethylenically unsaturated monomer (B) in the presence of a polyurethane emulsion (A) such that the weight ratio of polyurethane in said polyurethane emulsion (A) to monomer (B) is from 90/10 to 10/90, solidifying said emulsion in the impregnated fibrous substrate by heating, and if said fibrous substrate comprises a microfine fiber-forming fiber, converting the microfine fiber-forming fiber into a microfine fiber bundle, thereby producing a leather-like sheet, wherein a 100 μm thick resin film, obtained by drying the composite resin emulsion at 50° C., has an elastic modulus at 90° C. of $5.0\times10^8$ dyn/cm$^2$ or less.

2. The leather-like sheet of claim 1, wherein said fibrous substrate does not comprise a microfine fiber-forming fiber, and said 100 μm thick resin film has an elastic modulus at 90° C. of $1.0\times10^7$ dyn/cm$^2$ or more.

3. The leather-like sheet of claim 1, wherein said fibrous substrate comprises a microfine fiber-forming fiber, and said 100 μm thick resin film has an elastic modulus at 160° C. of $5.0\times10^6$ dyn/cm$^2$ or more.

4. The leather-like sheet of claim 1, wherein said fibrous substrate is a nonwoven fabric.

5. The leather-like sheet of claim 4, wherein the density of said fabric is 0.25–0.50 g/cm$^3$.

6. The leather-like sheet of claim 1, wherein said fibrous substrate is treated with one or more silicone-based compounds which block adhesion between the fiber and said composite resin.

7. The leather-like sheet of claim 3, wherein said microfine fiber-forming fiber is a microfine fiber-forming composite spun fiber or a microfine fiber-forming blend spun fiber.

8. The leather-like sheet of claim 1, wherein said weight ratio of polyurethane in said polyurethane emulsion (A) to monomer (B) is from 85/15 to 15/85.

9. The leather-like sheet of claim 1, wherein said ethylenically unsaturated monomer (B) comprises 90 to 99.9% by weight of a monofunctional ethylenically unsaturated monomer (B1) composed mainly of a derivative of (meth)acrylic acid and 10 to 0.1% by weight of a polyfunctional ethylenically unsaturated monomer (B2).

10. The leather-like sheet of claim 1, wherein said composite resin emulsion further comprises one or more polymers selected from the group consisting of acrylonitrile-butadiene copolymer, polybutadiene, polyisoprene, ethylene-propylene copolymer, polyacrylates, acrylic copolymers, silicones, polyurethanes, polyvinyl acetate, polyvinyl chloride, polyester-polyether block copolymers and ethylene-vinyl acetate.

11. A process for producing a leather-like sheet, comprising:

impregnating a fibrous substrate with a thermally gellable composite resin emulsion obtained by emulsion polymerizing an ethylenically unsaturated monomer (B) in the presence of a polyurethane emulsion (A) such that the weight ratio of polyurethane in emulsion (A) to monomer (B) is from 90/10 to 10/90, solidifying the emulsion in the impregnated fibrous substrate by heating, and if the fibrous substrate comprises a microfine fiber-forming fiber. converting the microfine fiber-forming fiber into a microfine fiber bundle, thereby producing a leather-like sheet, wherein a 100 μm thick resin film, obtained by drying the composite resin emulsion at 50° C., has an elastic modulus at 90° C. of $5.0\times10^8$ dyn/cm$^2$ or less.

12. The process of claim 11, wherein the fibrous substrate does not comprise a microfine fiber-forming fiber, and the 100 Jim thick resin film has an elastic modulus at 90° C. of $1.0\times10^7$ dyn/cm$^2$ or more.

13. The process of claim 11, wherein the fibrous substrate comprises a microfine fiber-forming fiber, and the 100 μm thick resin film has an elastic modulus at 160° C. of $5.0\times10^6$ dyn/cm$^2$ or more.

14. The process of claim 11, wherein the 100 μm thick resin film has an a dispersion temperature of −10° C. or lower.

15. The process of claim 11, wherein the fibrous substrate is pretreated with a fiber treating agent capable of blocking the adhesion between the fiber and the composite resin.

16. The process of claim 15, wherein the fiber treating agent capable of blocking adhesion between the fiber and the composite resin is a softening water-repellent compound comprising a mixture of dimethylpolysiloxane and methylhydrogenpolysiloxane.

17. The process of claim 11, wherein the composite resin has a thermal gelation temperature of 30 to 70° C., and the composite resin emulsion in the impregnated fibrous substrate is solidified at a temperature at least 10° C. higher than the thermal gelation temperature of the composite resin emulsion.

18. The process of claim 11, wherein the fibrous substrate comprises a nonwoven fabric having at least one component of a shrinkable polyethyleneterephthalate fiber and an apparent density of 0.25 to 0.50 g/cm$^3$.

19. The process of claim 11, wherein the fibrous substrate comprises a microfine fiber-forming fiber, and the polyurethane emulsion (A) is prepared from an aromatic isocyanate compound.

20. The process of claim 11, wherein the fibrous substrate comprises a microfine fiber-forming fiber, and the ethylenically unsaturated monomer (B) comprises 90–99.9% by weight of a (meth)acrylic acid derivative (B1) and 10–0.1% by weight of a polyfunctional ethylenically unsaturated monomer (B2).

21. The process of claim 11, wherein the fibrous substrate is a microfine fiber-forming fiber comprising at least one fiber selected from the group consisting of a sea-island type composite spun fiber, a sea-island type blend spun fiber, and mixtures thereof, said fibers comprising two or more polymers, and the sea component of the fiber is removed to convert the microfine fiber-forming fiber into a microfine fiber bundle.

22. The process of claim 11, wherein the sea component comprises at least one polymer selected from the group consisting of polyethylene, polystyrene, and mixtures thereof, and the island component comprises at least one polymer selected from the group consisting of polyester, polyamide, and mixtures thereof, and the sea component is removed after solidifying the emulsion to convert the microfine fiber-forming fiber into a microfine fiber bundle.

* * * * *